US010000854B2

(12) United States Patent
Ozasa

(10) Patent No.: US 10,000,854 B2
(45) Date of Patent: Jun. 19, 2018

(54) METHOD FOR PREVENTING ELUTION OF BI FROM COPPER ALLOY

(75) Inventor: Tomoyuki Ozasa, Yamanashi (JP)

(73) Assignee: KITZ CORPORATION, Chiba (JP)

( * ) Notice: Subject to any disclaimer, the term of this patent is extended or adjusted under 35 U.S.C. 154(b) by 93 days.

(21) Appl. No.: 13/817,187

(22) PCT Filed: Aug. 24, 2011

(86) PCT No.: PCT/JP2011/069048

§ 371 (c)(1),
(2), (4) Date: Feb. 15, 2013

(87) PCT Pub. No.: WO2012/026490

PCT Pub. Date: Mar. 1, 2012

(65) Prior Publication Data

US 2013/0142691 A1 Jun. 6, 2013

(30) Foreign Application Priority Data

Aug. 24, 2010 (JP) ..... 2010-187598

(51) Int. Cl.
*C23F 1/18* (2006.01)
*C23F 1/00* (2006.01)
(Continued)

(52) U.S. Cl.
CPC ..... *C23F 1/18* (2013.01); *B24C 3/322* (2013.01); *C23F 1/00* (2013.01); *E03B 7/006* (2013.01)

(58) Field of Classification Search
CPC ..... C23F 1/00; C23F 1/16; C23F 1/18; B24C 3/322; B24C 3/325; E03B 7/006
(Continued)

(56) References Cited

U.S. PATENT DOCUMENTS 6,270,590 B1 8/2001 Giusti
7,368,019 B2 * 5/2008 Sugaya ..... C23C 22/08 134/10
(Continued)

FOREIGN PATENT DOCUMENTS

JP 11-29887 2/1999
JP 11-510217 9/1999
(Continued)

OTHER PUBLICATIONS

Sugaya, JP Pub. No. 2008-088526 (machine translation).*
International Search Report dated Nov. 1, 2011 in International (PCT) Application No. PCT/JP2011/69048.

*Primary Examiner* — Keith Walker
*Assistant Examiner* — John A Hevey
(74) *Attorney, Agent, or Firm* — Wenderoth, Lind & Ponack, L.L.P.

(57) ABSTRACT

Provided is a method for preventing the elution of Bi from copper alloy, in which the elution of Bi is prevented in leadless copper-alloy plumbing equipment and the like containing a trace of lead and a predetermined amount of Bi. The present invention relates to a method for preventing the elution of Bi from copper alloy in which at least Bi present on the surface of copper alloy containing Bi is selectively removed by preferentially dissolving Bi in a 4 to 20 mass % concentration of nitric acid while suppressing Cu dissolution. Furthermore, elution of Pb is suppressed using a 10-20 mass % concentration of nitric acid. In this case, by removing at least Bi present on the surface of copper alloy containing Bi using nitric acid and then treating the surface of the copper alloy by shot-blasting corrosive products, such as oxides, produced from the nitric acid are removed, and gloss is imparted to the surface.

1 Claim, 13 Drawing Sheets

(51) Int. Cl.
*B24C 3/32* (2006.01)
*E03B 7/00* (2006.01)

(58) Field of Classification Search
USPC ..... 420/471, 472, 491, 499; 216/53, 106; 134/3; 75/743
See application file for complete search history.

(56) References Cited

U.S. PATENT DOCUMENTS

| | | | | |
|---|---|---|---|---|
| 2002/0043308 | A1 | 4/2002 | Giusti | |
| 2005/0241737 | A1* | 11/2005 | Ujiro et al. | 148/650 |
| 2007/0158002 | A1* | 7/2007 | Oishi | 148/434 |
| 2007/0166473 | A1* | 7/2007 | Sugaya | C23C 26/00 427/407.1 |

FOREIGN PATENT DOCUMENTS

| | | |
|---|---|---|
| JP | 2001-89883 | 4/2001 |
| JP | 3182765 | 4/2001 |
| JP | 3345569 | 8/2002 |
| JP | 2008-88526 | 4/2008 |

* cited by examiner (a)

(b)

(c)

(a)

(b)

(c)

| No. | Before treatment 2000 magnifications | After treatment 2000 magnifications |
|---|---|---|
| 1 |   |   |
| | Bi : 0.31% , Pb : 0.25% | Bi : 0.26% , Pb : 0.21% |
| 2 |   |   |
| | Bi : 1.18% , Pb : 0.27% | Bi : 0.82% , Pb : 0.17% |
| 3 |   |   |
| | Bi : 2.40% , Pb : 0.30% | Bi : 1.57% , Pb : 0.17% |
| 4 |   |   |
| | Bi : 1.07% , Pb : 0.26% | Bi : 0.78% , Pb : 0.21% |

| No. | Before treatment 2000 magnifications | After treatment 2000 magnifications |
|---|---|---|
| 5 |   |   |
| | Bi : 1.99% , Pb : 0.28% | Bi : 1.24% , Pb : 0.14% |
| 6 |   |   |
| | Bi : 1.10% , Pb : 0.27% | Bi : 0.74% , Pb : 0.16% |
| 7 |   |   |
| | Bi : 2.24% , Pb : 0.31% | Bi : 1.60% , Pb : 0.15% |
| 25 |   |   |
| | Bi : 0.68% , Pb : 0.29% | Bi : 0.47% , Pb : 0.19% |

| No. | Before treatment 2000 magnifications | After treatment 2000 magnifications |
|---|---|---|
| 26 |   |   |
| | Bi : 1.32% , Pb : 0.33% | Bi : 0.86% , Pb : 0.21% |
| 27 |   |   |
| | Bi : 1.87% , Pb : 0.32% | Bi : 1.26% , Pb : 0.24% |
| 8 |   |   |
| | Bi : 1.21% , Pb : 0.08% | Bi : 0.69% , Pb : 0.03% |
| 9 |   |   |
| | Bi : 1.26% , Pb : 0.05% | Bi : 0.79% , Pb : 0.02% |

| No. | Before treatment 2000 magnifications | After treatment 2000 magnifications |
|---|---|---|
| 10 |   |   |
| | Bi : 1.76% , Pb : 0.12% | Bi : 0.51% , Pb : 0.04% |
| 11 |   |   |
| | Bi : 2.39% , Pb : 0.06% | Bi : 1.41% , Pb : 0.02% |
| 12 |   |   |
| | Bi : 1.01% , Pb : 0.12% | Bi : 0.65% , Pb : 0.06% |
| 13 |   |   |
| | Bi : 1.97% , Pb : 0.14% | Bi : 1.27% , Pb : 0.08% |

| No. | Before treatment 2000 magnifications | After treatment 2000 magnifications |
|---|---|---|
| 14 |   |   |
| | Bi : 5.06% , Pb : 0.10% | Bi : 2.31% , Pb : 0.02% |
| 15 |   |   |
| | Bi : 2.34% , Pb : 0.17% | Bi : 1.06% , Pb : 0.04% |
| 16 |   |   |
| | Bi : 1.43% , Pb : 0.29% | Bi : 1.02% , Pb : 0.17% |
| 17 |   |   |
| | Bi : 1.04% , Pb : 0.17% | Bi : 0.70% , Pb : 0.10% |

| No. | Before treatment 2000 magnifications | After treatment 2000 magnifications |
|---|---|---|
| 18 |   |   |
| | Bi : 2.40% , Pb : 0.17% | Bi : 1.67% , Pb : 0.09% |
| 19 |   |   |
| | Bi : 1.84% , Pb : 0.18% | Bi : 1.31% , Pb : 0.08% |
| 20 |   |   |
| | Bi : 0.66% , Pb : 0.32% | Bi : 0.55% , Pb : 0.27% |
| 21 |   |   |
| | Bi : 3.51% , Pb : 0.35% | Bi : 2.55% , Pb : 0.27% |

| No. | Before treatment 2000 magnifications | After treatment 2000 magnifications |
|---|---|---|
| 22 |   |   |
| | Bi : 3.55% , Pb : 0.36% | Bi : 2.54% , Pb : 0.25% |
| 23 |   |   |
| | Bi : 4.06% , Pb : 0.16% | Bi : 2.04% , Pb : 0.10% |
| 24 |   |   |
| | Bi : 1.27% , Pb : 0.11% | Bi : 0.91% , Pb : 0.10% |
| 28 |   |   |
| | Bi : 1.00% , Pb : 0.30% | Bi : 0.69% , Pb : 0.21% |

METHOD FOR PREVENTING ELUTION OF BI FROM COPPER ALLOY

TECHNICAL FIELD

The present invention relates to a method for preventing the elution of Bi (bismuth) contained in an alloy material and particularly to a Bi elution prevention method in copper alloy for preventing the elution of Bi contained in the copper alloy from which plumbing equipment, such as a valve, joint or strainer, is made.

BACKGROUND ART

In recent years, Bi has been contained instead of lead in many cases in copper alloy constituting a material for plumbing equipment, such as water valves, joints, etc., for example, in order to enhance properties including cuttability while preventing the elution of lead from the copper alloy. Though it is said that Bi only has relatively low toxicity, stringent lixiviation standards are provided also relative to Bi, and Bi-containing products not able to satisfy the lixiviation standards are present depending on lixiviation test methods and shapes and sizes of the Bi-containing products. In addition, lead lixiviation standards become more and more stringent and, for example, leadless copper alloy containing a trace of lead as an unavoidable impurity possibly fails to satisfy the lead lixiviation standards. Under these circumstances, it becomes important for plumbing equipment used for water that lead elution is prevented and further that Bi elution is suppressed.

As a technique for preventing the elution of a harmful substance of this kind, the lead elution prevention method of Patent Document 1, for example, has been known. Patent Document 1 discloses the removal of lead from the water-contacting portion of bronze or brass plumbing equipment and, to be specific, the water-contacting surface of the plumbing equipment is treated with 0.5 to 7 wt % of nitric acid to enable the elution of lead to tap water to be suppressed to a great extent. On the other hand, Patent Document 2 discloses a lead elution reduction treating method aiming at removing lead from the surface of lead-containing copper alloy through immersion of the copper alloy in cleaning liquid comprising alkaline etching liquid. Patent Document 3 discloses a regeneration treatment method that suggests from Table 2 a possibility of enabling Bi to be removed from a water-contacting portion in treating copper alloy with chemical grinding treatment liquids containing 27 wt % or lower nitric acid. In addition, the lead-free copper alloy includes that which does not intend to contain Bi in alloy, thereby inducing a technique for suppressing the elution of Bi.

PRIOR ART DOCUMENTS

Patent Documents

[Patent Document 1] Japanese Patent No. 3345569
[Patent Document 2] Japanese Patent No. 3182765
[Patent Document 3] JP-A 2008-88526

SUMMARY OF THE INVENTION

Problems the Invention Intends to Solve

The lead elution prevention method of Patent Document 1, however, aims at preventing lead from elution and does not target at Bi elution prevention. In this technique, since the nitric acid concentration is low, the effect of removing Bi is not heightened and the technique is not suitable for utilization as a Bi elution prevention technique. In the treating method of Patent Document 2, since alkaline etching liquid is used as a wash solution, it is impossible for the alkaline wash solution to effectively remove Bi that is a novel metal element. In Patent Document 3, since copper and Bi have extremely near potentials, it is described that nitric acid similarly dissolves copper and Bi, and it is not disclosed that Bi is preferentially removed. Here, in Table 3 of Patent Document 3, shown is data for also removing Bi. However, the data targets at a sand casting. Since the sand casting exhibits surface segregation and since Bi galore also exists on the surface, data of samples having ground surfaces are needed in order to accurately comprehend the removal of Cu or Bi from the alloy surface. Therefore, Patent Document 3 merely discloses a technique of grinding the surface of copper alloy irrespective of the element Cu or Bi. Furthermore, in copper alloy containing Bi, when the lead content has been tightened in order to suppress the elution of lead, it becomes difficult to dissolve returned materials produced in factories or scrapped materials recovered from markets and reuse the dissolved materials, resulting in incapability of avoiding increased costs of products.

On the other hand, leadless copper alloy not containing Bi is inferior in machinability therefore to induce a problem of making it difficult to process products made from the material of the leadless copper alloy in mass production equipment using lead-containing copper alloy. In addition, in the case of leadless copper alloy containing Si, the recycle thereof is difficult to perform. To be specific, 85-5-5-5 alloy used for plumbing equipment, such as a valve, increases shrinkage cavities in the presence of Si to remarkably deteriorate the mechanical properties and durability thereof. The upper limit of the Si content is 0.01 mass % under the JIS standards and 0.005 mass % under the ASTM standards. In fact, however, since admixture of 0.003 mass % of Si induces adverse effects, a great problem is induced when scraps have contained Si. Thus, in the case of the leadless copper alloy not containing Bi, since the different problem is induced as the copper alloy, the copper alloy preferably contains Bi as a consequence.

The present invention has been developed in view of the above circumstances and through keen studies and the object thereof is to provide a method for preventing the elution of Bi from plumbing equipment made from leadless copper alloy containing a trace of lead and a predetermined amount of Bi.

Means for Solving the Problems

To attain the above object, the invention set forth in embodiment 1 is directed to a method for preventing the elution of Bi from copper alloy containing at least Bi and having a surface thereof on which Bi is present, comprising treating the surface of the copper alloy with nitric acid having a concentration of 4 to 20 mass % to suppress the dissolution of a matrix comprising Cu, Zn and Sn and preferentially dissolve the Bi, thereby removing the Bi selectively.

The invention set forth in embodiment 2 is directed to the method for preventing the elution of Bi, wherein the concentration of nitric acid is 10 to 20 mass % to selectively remove Bi and Pb.

The invention set forth in embodiment 3 is directed to a method for preventing elution of Bi from copper alloy containing at least Bi and having a surface thereof on which Bi is present, comprising removing the Bi using nitric acid and subjecting the surface of the copper alloy to shot-blasting to remove corrosive products including oxides produced from the nitric acid and impart gloss to the surface.

The invention set forth in embodiment 4 is directed to the method for preventing elution of Bi from copper alloy, wherein the shot-blasting is performed in a range of depths of void parts formed on the surface of the copper alloy as a result of removing the Bi using the nitric acid to suppress exposure of Bi present inward of the copper alloy.

The invention set forth in embodiment 5 is directed to the method for preventing elution of Bi from copper alloy, wherein the shot-blasting is performed for the purpose of blocking the void parts formed on the surface of the copper alloy as a result of removing the Bi using the nitric acid to suppress exposure of Bi present inward of the copper alloy.

Effects of the Invention

According to the invention set forth in embodiment 1, nitric acid is used to remove Bi from a water-contacting portion of plumbing equipment made from leadless copper alloy containing a trace of lead and Bi added particularly as a substitute for lead to enable elution of the Bi to be prevented. It is further possible to remove lead present on the water-contacting portion by this acid cleaning.

According to the invention set forth in embodiment 2, it is possible to effectively prevent elution of both Bi and Pb to enhance the mechanical properties including castability of the copper alloy and prevent elution of unhealthy materials, thereby enabling provision of highly safe products including plumbing equipment.

According to the invention set forth in embodiment 3, nitric acid is used to remove Bi from a water-contacting portion of plumbing equipment made from leadless copper alloy containing a trace of lead and Bi added particularly as a substitute for lead, and a shot-blasting step is utilized to enable removal of corrosive substances including oxides from the surface of the material, impartation of gloss thereto and improvement in tarnish by acid cleaning with the nitric acid.

According to the invention set forth in embodiment 1, by causing the range of the depths of the void parts formed on the surface of the copper alloy through the removal of Bi with nitric acid to conform to a shot-blasting depth, it is possible to set the marginal condition of the shot-blasting for satisfying the Bi elution standards to be optimal and, by performing the shot-blasting under this condition, it is possible to prevent Bi from being eluted, after the blasting, from the metal surface from which the Bi has been removed. In addition, by treating the metal surface with the shot-blasting in a minimum of depth, it is possible to impart gloss to the metal surface.

According to the invention set forth in embodiment 5, by blocking the metal surface treated with the nitric acid through the shot-blasting, it is possible to stop up the openings of the void parts formed by the Bi removal, suppress the Bi exposure and further heighten the effect of preventing Bi from being eluted from the metal surface having suppressed Bi elution by the treatment with the nitric acid.

MODE FOR CARRYING OUT THE INVENTION

Figure 1:
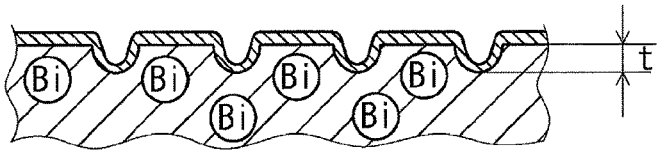
FIG. 1 is a pattern diagram showing the neighborhood of the surface of copper alloy.

A method for preventing the elution of Bi of Bi-containing copper alloy according to the present invention will be described hereinafter in detail based on an embodiment thereof. The first method for preventing the elution of Bi comprises using a 4 to 20 mass % concentration of nitric acid to suppress dissolution of Cu contained in and preferentially dissolve Bi from the surface of a copper-alloy-made valve or joint for tap water that contains at least Bi and contains a trace of lead and Bi, for example, thereby removing the Bi. Herein, the preferential removal by the dissolution means that a Bi elution ratio is higher than a dissolution ratio of the principal element (Cu, for example) constituting the matrix of the copper alloy. In this case, it is preferred that the concentration of the nitric acid is set to be 10 to 20 mass % and, at this time, that the elution of both Bi and Pb is effectively suppressed. In this instance, 5 min or more of the surface treatment time is preferred.

Here, as regards a concentrated nitric acid concentration in the present embodiment, 20 mass % of nitric acid, for example, indicates nitric acid obtained by diluting 60 mass % of concentrated nitric acid to 5 times. Of the 20% of nitric acid, there is 20% of nitric acid obtained by diluting 67% of concentrated nitric acid to 5 times as described in Patent Document 3. The 20% of nitric acid cited herein differs from the 20% concentration of nitric acid in the present embodiment. This is because, in the invention of Patent Document 3 (refer to paragraph 21 of the Description of Patent Document 3) that obtains nitric acid having a concentration of 20 to 27 wt % using 67% of concentrated nitric acid, the concentration of nitric acid becomes 22.3 to 30.2 wt % in terms of the case of using 60% of concentrated nitric acid.

A management concentration to obtain a nitric acid concentration most suitable for applying the method for preventing Bi elution of Bi-containing copper alloy according to the present invention to products actually produced is attained when nitric acid having a concentration of 15 to 20 mass % is obtained using 60 mass % of concentrated nitric acid and, in this case, the nitric acid concentration does not overlap the nitric acid concentration of 22.3 to 30.2 wt % in Patent Document 3. In addition, if the range of the nitric acid concentration of Patent Document 3 should overlap the range of the nitric acid concentration in the Bi elution prevention method of the present invention, since Patent Document 3 does not describe that Bi rather than copper is preferentially treated, as described above, the effect of preventing Bi elution cannot be expected. On the other hand, the nitric acid concentration shown in Patent Document 1 becomes 0.6 to 8.0% in terms of the 60% of concentrated nitric acid, the nitric acid concentration range in the present embodiment does not overlap that in Patent Document 1.

The second method for preventing the elution of Bi comprises removing with nitric acid Bi present on the surface of copper alloy containing at least Bi and subjecting the surface of the copper alloy to shot-blasting to remove corrosive products inclusive of oxides produced by the nitric acid and impart gloss to the surface.

When subjecting the copper alloy surface to shot-blasting, it is better that by performing the shot-blasting in the range of the depths of the void parts formed on the copper alloy surface by the removal of Bi with nitric acid, Bi present inward of the copper alloy is suppressed from being exposed to the outside.

Furthermore, by blocking the void parts formed on the copper alloy surface by the removal of Bi with nitric acid using the shot-blasting, Bi present inward of the copper alloy is suppressed from being exposed to the outside.

The installation for performing the shot-blasting includes apron-type, hanger-type and drum-type systems, for example. Any one of the systems may suitably be selected in accordance with a material composition, product kind or intended use. The material for shot balls includes various kinds of materials, such as steel, stainless steel, glass and sand, for example. Appropriately selected one of them can be used. In this case, since Bi is newly exposed from the surface of a workpiece when the grinding amount has been large, it is desirable to use shot balls having a small diameter in order to reduce collision energy relative to the workpiece surface or use preferably spherical shot balls in order to obtain the effect of compressing the workpiece surface without grinding the same. It is preferable that the shot balls of the shot-blasting have a diameter of 0.1 to 0.6 mm, for example, more preferably 0.3 to 0.6 mm and, with this, tarnish resulting from oxidized scale can effectively be removed.

In the case of performing the shot-blasting, by setting the thickness $T_1$ (μm) of alloy removed through grinding by the shot-blasting to be equal to 0.1 to 0.65 R/X in which R (μm) denotes the average crystalline particle diameter of Bi phases present as dispersed in the alloy and X (mass %) denotes the Bi content, it is possible to suppress the elution of Bi. At this time, it is possible to suppress the lixiviation amount of Bi from the copper alloy to less than 100 ppb.

In respect of the shot-blasting, the conditions for suppressing the amount of Bi elution will be examined in more detail. FIG. 1 is a pattern diagram showing the neighborhood of the surface of copper alloy comprising CAC911. The CAC911 has chemical component values shown in Table 1.

TABLE 1

| | Sn | Zn | Bi | Se | Pb | P | Cu |
|---|---|---|---|---|---|---|---|
| Chemical component value (mass %) | 4.6 | 8.9 | 1.4 | 0.19 | 0.07 | 0.03 | Balance |

Figure 2:
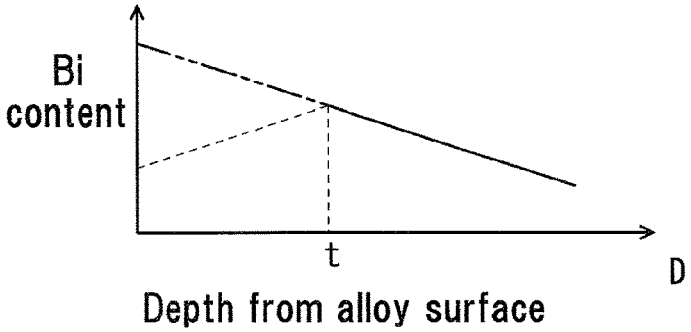
FIG. 2 is a graph showing the relationship between the depth of the alloy surface and the Bi content.

In FIG. 1, the larger the amount of grinding by shot-blasting (depth) performed subsequent to the surface treatment with nitric acid, the larger the area ratio of Bi exposed from the surface is. The shot balls used in the shot-blasting collide against the range of the alloy surface shown by hatched lines in the figure. In this case, the relationship between the depth D from the alloy surface and the Bi content of the alloy is, as shown by declination in FIG. 2, that the larger the depth from the alloy surface, the smaller the Bi content is. So-called inverse segregation meaning that Bi is segregated in the alloy surface is reflected in this declination. In FIG. 2, by making the maximum depth $D_{max}$ when the alloy surface is ground by the shot-blasting smaller than the depth t from the alloy surface after removal of Bi with nitric acid, it is possible to prevent Bi from newly emerging from the copper alloy surface through grinding by shot-blasting after the removal of Bi with nitric acid. In FIG. 2, a two-dot chain line shows a phantom line when the treatment with nitric acid has not been performed.

To be Specific, when the crystalline particle diameter of Bi phases is expressed as R (μm), the maximum depth of corrosion with nitric acid is R (μm), with matrix corrosion disregarded. Therefore, when the amount of grinding exceeds R (μm), the Bi phases are newly exposed completely from the alloy surface. In addition, since the smaller the crystalline particle diameter R of the Bi phases, the smaller the amount of grinding to be suppressed, it is necessary to select a method of grinding requiring small energy.

For example, the standard value of the Bi elution amount in the NSF lixiviation test provided in the standards on public safety and sanitation is 100 ppb and, in products having undergone surface treatment with nitric acid (hereinafter referred to as the surface-treated products), it becomes about 100 to 150 ppb. Therefore, suppression of the elution amount to around 50% (50 to 75 ppb) can sufficiently satisfy the standard value. In other words, 50% of area ratio of Bi on the alloy surface can satisfy the standard value and, to attain this, the amount of grinding by the shot-blasting may be less than R/2.

In addition, as the factor affecting the Bi lixiviation amount, the Bi content of the alloy can be raised. Since the Bi content of the alloy bears a proportionate relationship to the Bi lixiviation amount, with the CAC911 having the Bi content of 1.3 (mass %) as a reference, the Bi lixiviation amount of alloy having the Bi content of X becomes a multiple of X/1.3. Therefore, the amount of the alloy capable of being ground by the shot-blasting is a multiple of 1.3/X It is found from these that the amount of grinding by the shot-blasting for suppressing the Bi content of a surface-treated product of alloy having the average crystalline particle diameter of R (μm) and the Bi content of X (mass %) to 50 to 75 ppb is expressed as $R/2\times1.3/X=0.65\ R/X$ and this becomes the upper limit of the grinding amount.

The lower limit of the grinding amount is set to be the grinding amount under the shot-blasting conditions capable of removing tarnish. Since the shot time of at least of 1 min is needed in consideration of the finish irregularities in the high-volume production, 0.1 μm of grinding amount in shot time of 1 min in the case of using shot balls of stainless steel having a diameter of 0.3 mm is set to be the lower limit. From the above, it is possible to clear the NSF lixiviation test when the thickness $T_1$ of the surface removed by grinding has been set to 0.1 to 0.65 R/X (μm) and provide products each having a Bi lixiviation amount suppressed.

In the case of suppressing Pb elution in addition of prevention of Bi elution in performing the shot blasting, the thickness $T_2$ to be removed by the grinding, when the average crystalline particle diameter of Bi phases present as dispersed in alloy has been expressed as R (μm) and the Bi content as Y (mass %), is determined to be $T_2$=0.1 to 0.141 R/Y (μm) to suppress the Pb elution. In this case, it is possible to suppress the amount of Pb lixiviated from the copper alloy to less than 15 ppb.

The shot-blasting conditions for suppressing the amount of Pb elution are examined in further detail. The amount of Pb elution of a surface-treated product containing 0.47 (mass %) of Pb becomes around 50 ppb and, since the reference value of Pb is 15 ppb, it is necessary that the amount of Pb elution be 15/50. In addition, since Pb is alloyed with Bi phases in the alloy, when the average crystalline particle diameter of the Pb phases is to be shown, it is expressed similarly to the average crystalline particle diameter R of the Bi phases. For this reason, in order to suppress the exposure of Pb to 15/50, the amount of grinding the alloy by the shot-blasting is to be less than 15/50×R.

In addition, since the amount of Pb elution is proportional to its content similarly to the case of Bi, with CAC911 containing 0.47 (mass %) of Pb as a reference, the amount of Pb elution of alloy having a Pb content of Y becomes a multiple of Y/0.47 and the amount of the alloy capable of being ground by shot-blasting becomes 0.47/Y. It is found from these that the amount of grinding by shot-blasting for suppressing to less than 15 ppb the amount of Pb elution of treated products made of alloy having a Bi average crystalline particle diameter of R (μm) and a Pb content of Y (mass %) is expressed as 15/50×R×0.47/Y=0.141 R/Y and this is the upper limit of the grinding amount.

The limit of the grinding amount is set to the lower limit 0.1 μm of the grinding amount when the shot balls of stainless steel having a diameter of 0.3 mm have been used in the shot time of 1 min similarly to the case of the prevention of the Bi elution. Thus, by setting the thickness $T_2$ of the alloy to be removed by grinding to 0.1 to 0.141 R/Y (μm), it is possible to clear the NSF lixiviation test and provide products having the Pb elution suppressed to less than 15 ppb.

Furthermore, by setting the thickness $T_3$ of the alloy to be removed by grinding to 0.1 to 0.047 R/Y (μm) to suppress the Pb elution, it is also possible to suppress the amount of Pb lixiviated from the copper alloy to a lower amount of less than 5 ppb.

The above replies to the case where the Pb elution standards are severer, for example. In this case, the amount of grinding by shot-blasting for suppressing to less than 5 ppb the amount of the Pb elution of a surface-treated product made of alloy having the Bi average crystalline particle diameter of R (μm) and Pb content of Y (mass %) is similarly expressed as 5/50×R×0.47/Y=0.047 R/Y and this is the upper limit of the grinding amount. Therefore, by setting the thickness $T_3$ of the alloy to be removed by grinding to 0.1 to 0.047 R/Y (μm), it is possible to clear the NSF lixiviation test and provide products having the Pb elution amount suppressed to less than 5 ppb.

Figure 3:
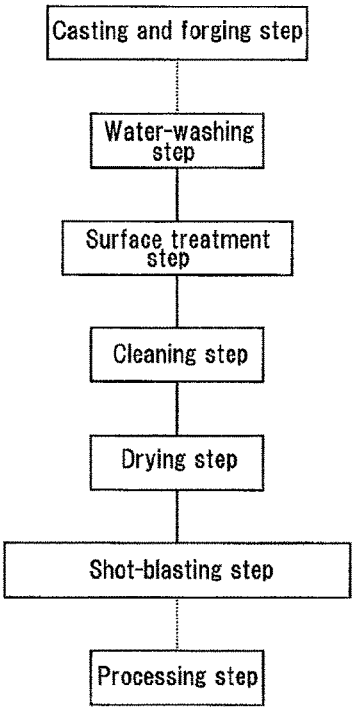
FIG. 3 is a flowchart showing an example of processing steps of a Bi elution prevention method according to the present invention.

In the case where the leadless copper alloy is surface-treated by the Bi elution prevention method of the present invention, it is desirable to treat plumbing equipment made from copper alloy in accordance with treatment steps concretely shown in the flowchart in FIG. 3, for example. In this case, as shown in the figure, in addition to a surface treatment step and a shot-blasting step in the Bi elution prevention method of the present invention, the treatment steps the present invention has targeted include a water-washing step, a cleaning step and a drying step, and the surface treatment of the copper alloy is performed through the water-washing step, a surface treatment step, the cleaning step, the drying step and a shot-blasting step in the order mentioned as the treatment steps the present invention has targeted at. The Bi elution prevention method of the present invention may be performed in accordance with other treatment steps than those in the order shown by the flowchart in FIG. 3, and it is possible to add appropriate treatment steps or omit the treatment steps shown above.

A water-washing step is carried out, prior to performing surface treatment of copper alloy, for removing dirt and speck from the metal surface. The water-washing step may comprise, for example, introducing copper-alloy-made plumbing equipment into a water vessel not shown, swinging the equipment manually in water and immersing the equipment in the water. Where the casting surface of the copper alloy is intensively convexo-concave and the one-time water-washing step fails to sufficiently remove the dirt and speck, the dirt and speck caking on the surface possibly induce reaction irregularity in a subsequent surface treatment step and inferiority of surface treatment liquid. For this reason, as occasion demands, the water-washing step is carried out again, with ultrasonic cleaning used concurrently and a defatting agent used.

The surface treatment step is performed for removing Bi and Pb from the copper alloy surface with nitric acid as described above and, in this case, by setting the nitric acid concentration to 4 to 30 mass %, more preferably 10 to 20 mass %, it becomes possible to heighten the effect of preventing the elution of Bi and Pb.

A cleaning step is performed by water cleaning. This water cleaning removes the nitric acid with which the copper alloy surface has been treated as well as corrosive products which are produced on the copper alloy surface in consequence of the surface treatment and which are black oxides, for example. The cleaning step is a pretreatment step of a shot-blasting step and, since the corrosive products have to be removed as many as possible, water washing with ultrasonic cleaning used concurrently is preferred. The copper alloy surface having undergone the cleaning step does not have gloss copper has per se and is brought to a state changed to brown. After the cleaning step, as shown in FIG. 3, a drying step is used to wipe the cleaning liquid. In the drying step, heating means is not necessarily used and general natural drying will suffice.

Subsequently, in the shot-blasting step, the corrosive products on the copper alloy surface are removed and the color changed to brown is removed to bring the color close to gloss of the copper alloy prior to the surface treatment step. The void parts formed after the removal of Bi have their openings stopped up with the shot balls.

Incidentally, in a processing step, when a product is a valve made of copper alloy, for example, appropriate processing, such as screw processing of pipe connection parts or cutting work of a valve seat part, is performed.

As materials capable of effectively preventing the elution of Bi or Pb by the use of the Bi elution prevention method of the present invention, raised are CAC901, CAC902, CAC903B, CAC904, CAC911 and CAC912 that are Bi-containing leadless copper alloys belonging to bronze. In addition, leadless copper alloys belonging to bronze, not containing Bi and capable of effectively preventing the elution of Pb alone include CAC411 and CAC804. Furthermore, continuously casting alloys include CAC411C, CAC804C, CAC901C, CAC902C, CAC903C, CAC904C and CAC911C. One example of concrete component ranges targeting at CAC 901, CAC902 and CAC903B in JIS H5120 comprises 83.5 to 90.6 mass % of Cu, 4.0 to 6.0 mass % of Sn, 4.0 to 8.0 mass % of Zn, exceeding 0.4 mass % and 3.5 of less mass % of Bi and unavoidable impurities. In addition, one example targeting at CAC911 in JIS H5120 comprises 83.0 to 90.6 mass % of Cu, 3.5 to 6.0 mass % of Sn, 4.0 to 9.0 mass % of Zn, 0.8 to 2.5 mass % of Bi, 0.1 to 0.5 mass % of Se and unavoidable impurities. Furthermore, one example targeting at CAC912 in JIS H5120 comprises 83.3 to 90.4 mass % of Cu, 2.5 to 5.5 mass % of Sn, 5.0 to 9.0 mass % of Zn, 0.8 to 1.5 mass % of Bi, 0.1 to 0.5 mass % of Se, 0.2 to 1.0 mass % of Ni, 0.1 to 0.25 mass % of P and unavoidable impurities. Moreover, one example targeting at C89325 under US CDA standards comprises 84.0 to 88.0 mass % of Cu, 0.02 to 0.2 mass % of Fe, 9.0 to 11.0 mass % of Sn, 1.0 to 5.0 mass % of Zn, 2.7 to 3.7 mass % of Bi, 0.3 to 1.0 mass % of Ni, 0.1 to 0.5 mass % of Sb and unavoidable impurities. In addition, one example targeting at C89837 under US CDA standards comprises 84.0 to 88.0 mass % of Cu, 0.2 to 0.5 mass % of Fe, 3.0 to 4.0 mass % of Sn, 6.0 to 10.0 mass % of Zn, 0.7 to 1.2 mass % of Bi, 0.3 to 1.0 mass % of Ni, 0.1 to 0.5 mass % of Sb and unavoidable impurities. Furthermore, materials belonging to brass and capable of effectively preventing the elution of Bi or Pb include, for example, Bi—Se-based leadless brass materials, such as C6803, and Bi-based leadless brass materials, such as C6801.

Though it is known that Bi or copper that is an elementary substance is dissolved with nitric acid that is a oxidizing acid, by being treated by the Bi elution prevention method of the present invention, Bi has preferentially been dissolved in spite of the fact that copper and Bi exhibit close potentials in an appropriate concentration of nitric acid. Furthermore, it has been confirmed that copper alloy having undergone surface treatment in the present invention sufficiently satisfies the lixiviation standard value aimed at.

In this regard, the copper alloy having been surface-treated only with nitric acid changes to blackish brown by means of oxidized scale of CuO and is as-is difficult to use as a product. The oxidized scale can be removed by ultrasonic cleaning and chemical grinding. However, though the workpiece surface having undergone chemical grinding becomes beautiful, differs in tint from an ordinary product obtained by shot-blasting as a final step and is very active and, therefore, is easily tarnished by hand marks. Thus, the workpiece surface is very difficult problematically to handle.

In view of the above, by carrying out shot-blasting after surface treatment to prevent color change and thereafter processing, it is possible to satisfy the lixiviation standards of lead and Bi and, at the same time, obtain leadless-copper-alloy-made plumbing equipment having a beautiful and stable surface film.

Incidentally, the prior art references of Patent Documents 1 to 3 target at processed parts of plumbing equipment including valves having casting materials screw-processed, whereas the present invention targets at parts before being processed, i.e. castings or materials immediately after being cast, used for plumbing equipment and differs in processing object. The Bi elution prevention method of the present invention is suitable for water-contacting products including valves, joints, pipes, water faucets, water supplies and hot-water supplies materials. Other members and parts suitable for the Bi elution prevention method of the present invention are particularly water-contacting parts including valves or water faucets, i.e. ball valves, balls for empties in ball valves, butterfly valves, gate valves, globe valves, check valves, water tap faucets, mounting hardware for hot water dispensers or toilet seats with a warm-water shower feature, water supply pipes, connection pipes and pipe joints, refrigerant pipes, electric water heater parts (casings, gas nozzles, pump parts, burners, etc.), strainers, water meter parts, underwater sewage system parts, water discharge plugs, elbow pipes, bellows, toilet-bowl connection flanges, spindles, joints, headers, corporation cocks, hose nipples, attached clasps for water faucets, stop cocks, water supply and discharge delivery tap supplies materials, sanitary crockery clasps, hose connection clasps for a shower, adapters for a casting pipe header and water meter parts. The method of the present invention can widely be applied to other members and parts.

Example 1

In order to confirm nitric acid concentration and treatment time capable of effectively removing lead and Bi, the casting surface of copper alloy was surface-treated, with the nitric acid concentration and treating time varied in the surface treatment step, and the results thereof were confirmed. The copper alloy to be used was regarded as Sample 1 and the chemical component values of Sample 1 are shown in Table 2. Sample 1 has a high Pb content of 0.47 mass % as shown in the table and thus falls outside the composition range of CAC911. Generally, CAC911 contains a trace of Pb that is 0.05 to 0.1 mass %. By heightening the ratio of Pb content, however, a tendency of Pb removal state is easy to grasp. For this reason, the ratio of the Pb content of Sample 1 is heightened.

TABLE 2

| | Sn | Zn | Bi | Se | Pb | P | Cu |
|---|---|---|---|---|---|---|---|
| Chemical component value of Sample 1 (mass %) | 4.0 | 8.1 | 1.5 | 0.18 | 0.47 | 0.02 | Balance |

Figure 4:
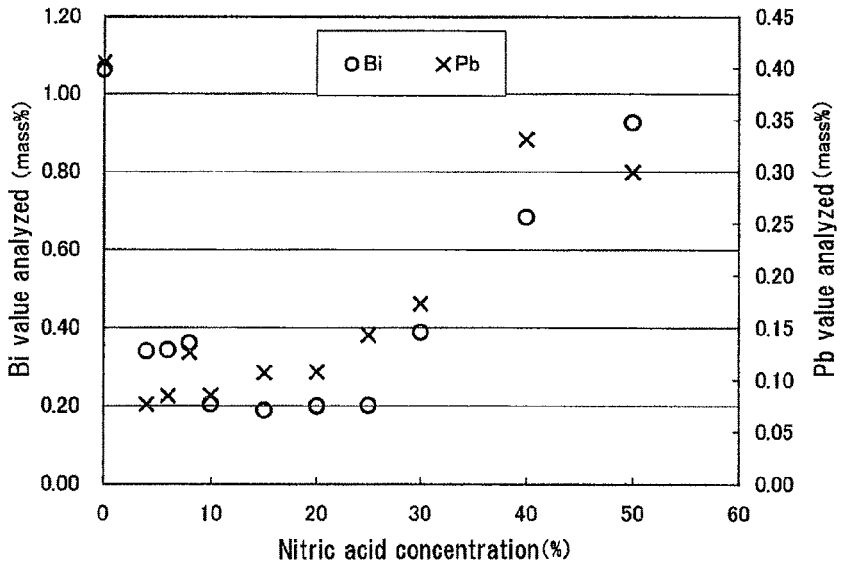
FIG. 4 is a graph showing the relationship among the nitric acid concentration, Bi and Pb.

Measurement results of Bi and those of Pb on the casting surface of Sample 1 with XGT (X-ray fluorescence spectrometer) after the surface treatment are shown in Table 3 and Table 4, respectively, and shown by graphs in FIG. 4. The unit of numerals showing the Bi and Pb contents in Table 3 and Table 4 is mass %.

TABLE 3

| | | Treatment time (min) | | | | |
|---|---|---|---|---|---|---|
| | | 0 | 5 | 10 | 20 | 30 |
| Nitric acid concentration (%) | 0 | 1.06 | | | | |
| | 4 | | | 0.34 | 0.34 | 0.35 |
| | 6 | | | 0.34 | 0.35 | 0.34 |
| | 8 | | | 0.36 | 0.31 | 0.33 |
| | 10 | | 0.36 | 0.20 | | |
| | 15 | | 0.25 | 0.19 | | |
| | 20 | | 0.23 | 0.20 | | |
| | 25 | | 0.26 | 0.20 | | |
| | 30 | | | 0.39 | | |

TABLE 3-continued

| | Treatment time (min) | | | | |
|---|---|---|---|---|---|
| | 0 | 5 | 10 | 20 | 30 |
| 40 | | | 0.68 | | |
| 50 | | | 0.93 | | |

Bi content: 1.5 mass %

It has been confirmed from the results in Table 3 that the nitric acid concentration capable of removing Bi is 4 to 40 mass %, preferably 10 to 25 mass %. The treatment time at this time is 5 min or more, preferably 10 min or more. It has been confirmed that Bi can effectively be removed by carrying out the surface treatment under these conditions.

TABLE 4

| | | Treatment time (min) | | | | |
|---|---|---|---|---|---|---|
| | | 0 | 5 | 10 | 20 | 30 |
| Nitric acid concentration (%) | 0 | 0.41 | | | | |
| | 4 | | | 0.08 | 0.10 | 0.09 |
| | 6 | | | 0.08 | 0.11 | 0.09 |
| | 8 | | | 0.13 | 0.12 | 0.12 |
| | 10 | | 0.10 | 0.09 | | |
| | 15 | | 0.10 | 0.11 | | |
| | 20 | | 0.13 | 0.11 | | |
| | 25 | | 0.14 | 0.14 | | |
| | 30 | | | 0.17 | | |
| | 40 | | | 0.33 | | |
| | 50 | | | 0.30 | | |

Lead content: 0.47 mass %

It has been confirmed from the results in Table 4 that Pb can be removed with nitric acid. Since it has been known conventionally that a lower nitric acid concentration is suitable for the removal of Pb, it has been confirmed from the results in Table 1 and Table 2 that the surface treatment is desirably performed under the conditions of the nitric acid concentration of 10 to 20 mass % and the treatment time of 10 min or more.

Next, data of treating with nitric acid copper alloy having a composition containing Cu or Zn are shown in Table 5 and Table 6 to confirm that Bi and Pb present on the surface of copper alloy containing Bi and Pb are preferentially dissolved to remove the Bi and Pb. Table 5 and Table 6 show the data on the nitric acid concentration and treatment time in respect of the composition of copper alloy.

TABLE 5

| | | 0 min | 5 min | 10 min | 20 min | 30 min |
|---|---|---|---|---|---|---|
| 0% | Cu | 87.8 | | | | |
| | Sn | 4.3 | | | | |
| | Zn | 6.3 | | | | |
| | Bi | 1.06 | | | | |
| | Se | 0.12 | | | | |
| | Pb | 0.41 | | | | |
| 4% | Cu | | | 88.4 | 88.6 | 88.4 |
| | Sn | | | 4.6 | 4.5 | 4.4 |
| | Zn | | | 6.5 | 6.3 | 6.5 |
| | Bi | | | 0.34 | 0.34 | 0.35 |
| | Se | | | 0.12 | 0.16 | 0.21 |
| | Pb | | | 0.08 | 0.10 | 0.09 |
| 6% | Cu | | | 88.1 | 87.9 | 88.3 |
| | Sn | | | 4.5 | 4.5 | 4.4 |
| | Zn | | | 6.8 | 7.0 | 6.7 |
| | Bi | | | 0.34 | 0.35 | 0.34 |
| | Se | | | 0.15 | 0.21 | 0.23 |
| | Pb | | | 0.08 | 0.11 | 0.09 |

TABLE 5-continued

| | | 0 min | 5 min | 10 min | 20 min | 30 min |
|---|---|---|---|---|---|---|
| 8% | Cu | | | 88.3 | 88.5 | 88.1 |
| | Sn | | | 4.5 | 4.4 | 4.3 |
| | Zn | | | 6.5 | 6.4 | 6.9 |
| | Bi | | | 0.36 | 0.31 | 0.33 |
| | Se | | | 0.21 | 0.30 | 0.31 |
| | Pb | | | 0.13 | 0.12 | 0.12 |
| 10% | Cu | | 88.4 | 89.7 | | |
| | Sn | | 4.4 | 4.3 | | |
| | Zn | | 6.5 | 5.6 | | |
| | Bi | | 0.36 | 0.20 | | |
| | Se | | 0.15 | 0.11 | | |
| | Pb | | 0.10 | 0.09 | | |
| 15% | Cu | | 88.7 | 89.5 | | |
| | Sn | | 4.4 | 4.4 | | |
| | Zn | | 6.3 | 5.7 | | |
| | Bi | | 0.25 | 0.19 | | |
| | Se | | 0.18 | 0.13 | | |
| | Pb | | 0.10 | 0.11 | | |
| 20% | Cu | | 89.4 | 88.2 | | |
| | Sn | | 4.4 | 4.4 | | |
| | Zn | | 5.7 | 6.9 | | |
| | Bi | | 0.23 | 0.20 | | |
| | Se | | 0.13 | 0.20 | | |
| | Pb | | 0.13 | 0.11 | | |
| 25% | Cu | | 88.6 | 89.1 | | |
| | Sn | | 4.4 | 4.1 | | |
| | Zn | | 6.5 | 6.3 | | |
| | Bi | | 0.26 | 0.20 | | |
| | Se | | 0.17 | 0.18 | | |
| | Pb | | 0.14 | 0.14 | | |
| 30% | Cu | | | 87.8 | | |
| | Sn | | | 4.6 | | |
| | Zn | | | 6.8 | | |
| | Bi | | | 0.39 | | |
| | Se | | | 0.26 | | |
| | Pb | | | 0.17 | | |
| 40% | Cu | | | 87.4 | | |
| | Sn | | | 4.8 | | |
| | Zn | | | 6.4 | | |
| | Bi | | | 0.68 | | |
| | Se | | | 0.32 | | |
| | Pb | | | 0.33 | | |
| 50% | Cu | | | 86.5 | | |
| | Sn | | | 4.8 | | |
| | Zn | | | 7.1 | | |
| | Bi | | | 0.93 | | |
| | Se | | | 0.31 | | |
| | Pb | | | 0.30 | | |

TABLE 6

| Survey of Lower Limit of Nitric Acid Concentration | | | | |
|---|---|---|---|---|
| | | | 0 min | 10 min |
| 0% | Cu | | 89.2 | |
| | Sn | | 2.7 | |
| | Zn | | 6.1 | |
| | Bi | | 1.23 | |
| | Se | | 0.14 | |
| | Pb | | 0.49 | |
| 2% | Cu | | | 90.2 |
| | Sn | | | 2.7 |
| | Zn | | | 6.0 |
| | Bi | | | 0.85 |
| | Se | | | 0.16 |
| | Pb | | | 0.08 |
| 3% | Cu | | | 90.8 |
| | Sn | | | 2.8 |
| | Zn | | | 5.6 |
| | Bi | | | 0.65 |
| | Se | | | 0.14 |
| | Pb | | | 0.07 |

TABLE 6-continued

| Survey of Lower Limit of Nitric Acid Concentration | | 0 min | 10 min |
|---|---|---|---|
| 4% | Cu | | 90.6 |
| | Sn | | 2.8 |
| | Zn | | 6.1 |
| | Bi | | 0.29 |
| | Se | | 0.12 |
| | Pb | | 0.09 |
| 6% | Cu | | 90.5 |
| | Sn | | 2.8 |
| | Zn | | 6.1 |
| | Bi | | 0.39 |
| | Se | | 0.13 |
| | Pb | | 0.08 |
| 10% | Cu | | 91.1 |
| | Sn | | 2.7 |
| | Zn | | 5.8 |
| | Bi | | 0.18 |
| | Se | | 0.09 |
| | Pb | | 0.08 |

According to the data in Table 5 and Table 6 obtained using the XGT, it has been confirmed that Bi and Pb were preferentially dissolved to selectively remove the Bi and Pb. In Table 5, the value of Cu is 87.8 wt % in an untreated state (nitric acid concentration of 0% and treatment time of 0 min), and the treatments with the nitric acid concentration increased to 4% and 6% exhibited no great change that the values of Cu were 88.8 wt % and 88.1 wt %, respectively (slight increases of the values were resulted from the measurement errors in the XGT analyses). In contrast to these, the value of Bi is 1.06 wt % in the untreated state (nitric acid concentration of 0% and treatment time of 0 min) and, in consequence of the treatments with the nitric acid concentrations increased to 4% and 6%, the values of Bi decreased to 0.34 wt % and 0.34 wt %, respectively, to show the preferential removal of Bi. In addition, the value of Pb is 0.41 wt % in the untreated state (nitric acid concentration of 0% and treatment time of 0 min) and, in consequence of the treatments with the nitric acid concentrations increased to 4% and 6%, the values of Pb decreased to 0.08 wt % and 0.08 wt %, respectively, to also show the preferential removal of Pb. When the nitric acid concentration was 25% or more, the value of Pb increased to 0.14 wt % to show the tendency to lower the Pb dissolution performance. In addition, when the nitric acid concentration was 30% or more, the value of Bi increased to 0.39 wt % to show the tendency to also lower the Bi dissolution performance.

In addition, why the nitric acid concentration for selective removal of Bi is 4 to 30 mass % will be described based on Table 3 to Table 6.

The standard value of Bi elution amount in the NSF lixiviation test is 100 ppb and that of a product not having undergone surface treatment with nitric acid is about 100 to 150 ppb. Therefore, suppression of the elution amount to about 50% (50 to 75 ppb) can sufficiently satisfy the standard value. Thus, since the area ratio of Bi is 1.06% in Table 3, it is understood that the area ratio of Bi is reduced to 50% or less. Therefore, the upper limit of the area ratio of Bi is 0.53% or less.

Figure 9:
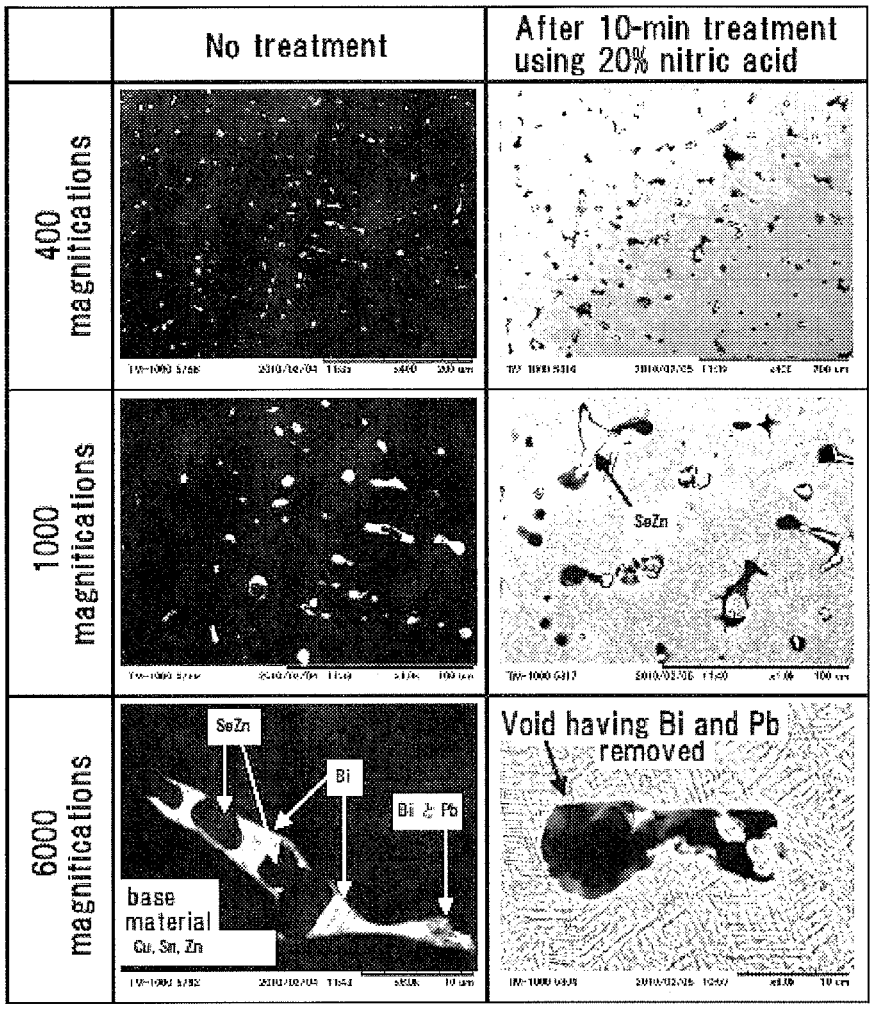
FIG. 9 includes micrograms showing the surfaces of copper alloy.
Figure 10:
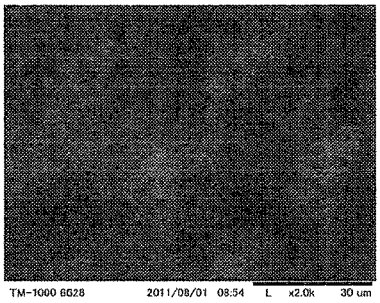
FIG. 10 includes micrograms showing the surfaces of copper alloys.
Figure 10:
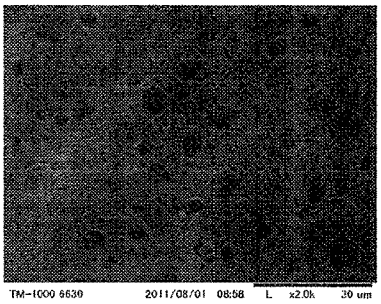
Figure 10:
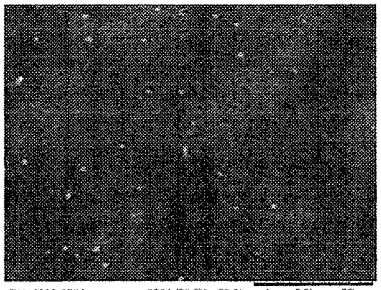
Figure 10:
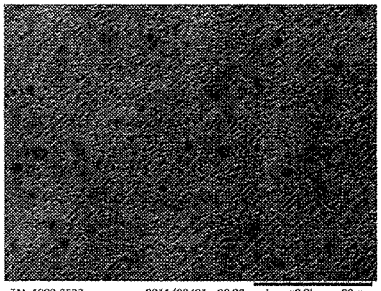
Figure 10:
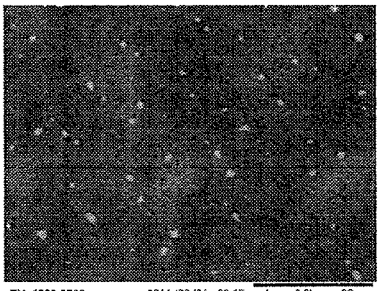
Figure 10:
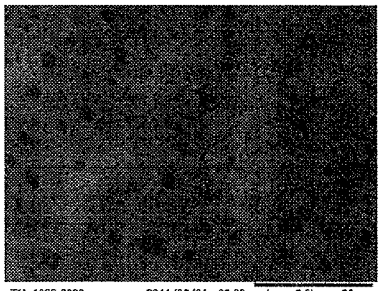
Figure 10:
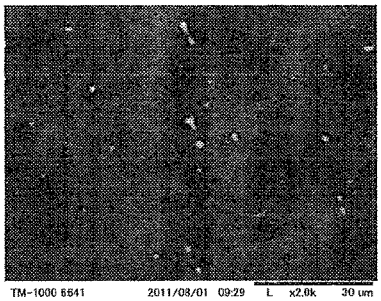
Figure 10:
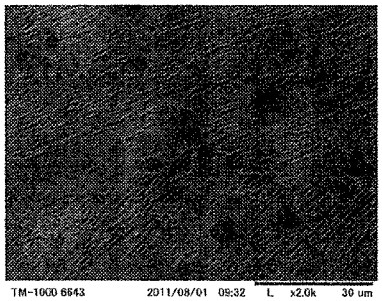
Figure 11:
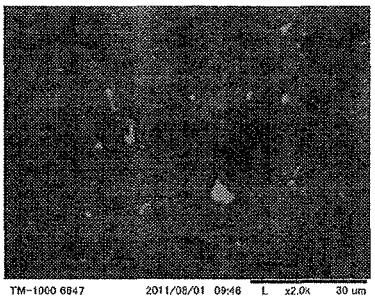
FIG. 11 includes micrograms showing the surfaces of copper alloys.
Figure 11:
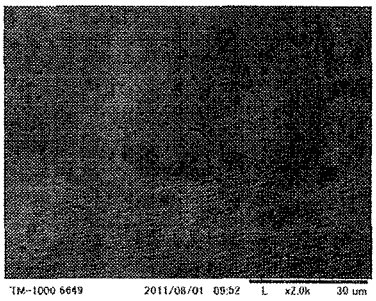
Figure 11:
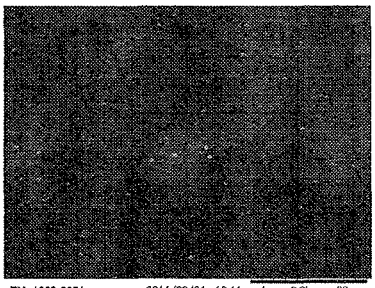
Figure 11:
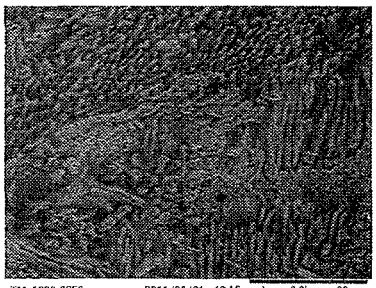
Figure 11:
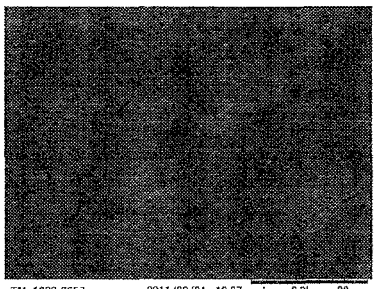
Figure 11:
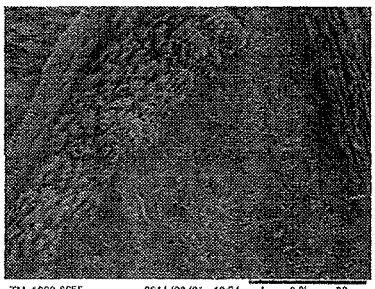
Figure 11:
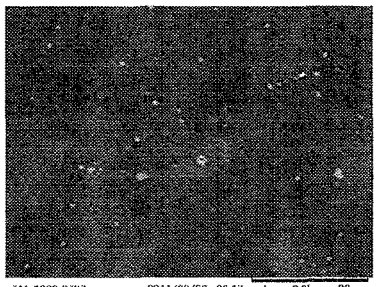
Figure 11:
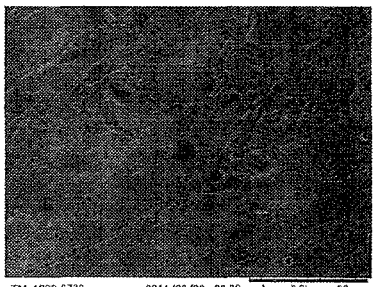
Figure 12:
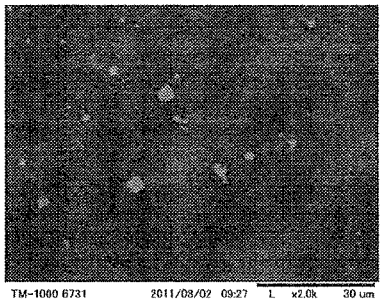
FIG. 12 includes micrograms showing the surfaces of copper alloys.
Figure 12:
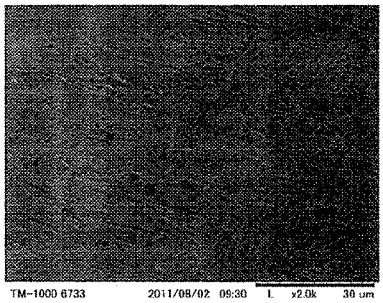
Figure 12:
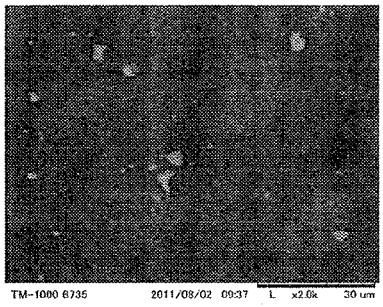
Figure 12:
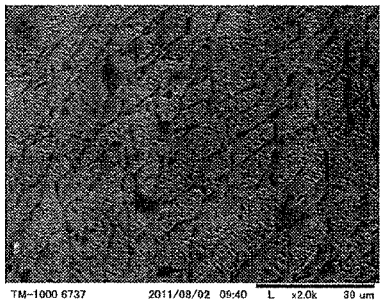
Figure 12:
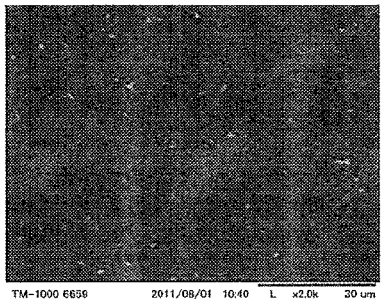
Figure 12:
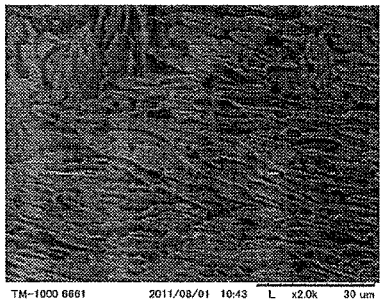
Figure 12:
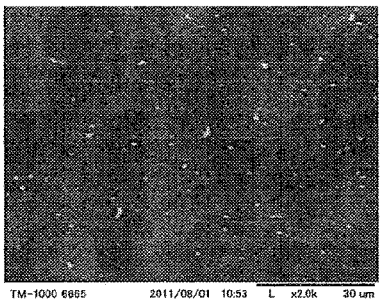
Figure 12:
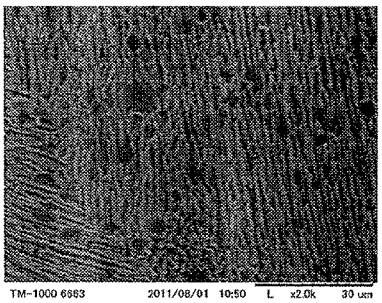
Figure 13:
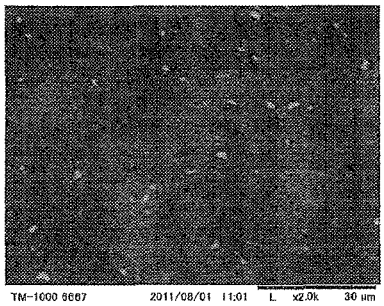
FIG. 13 includes micrograms showing the surfaces of copper alloys.
Figure 13:
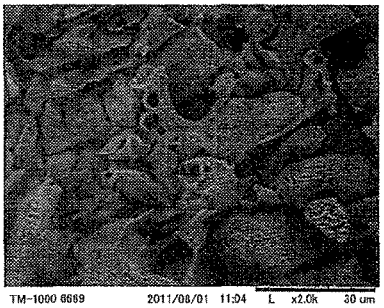
Figure 13:
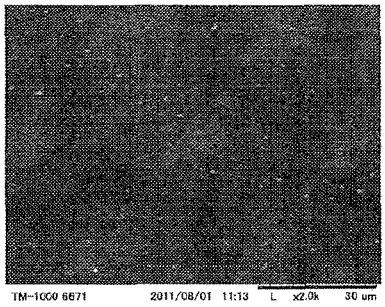
Figure 13:
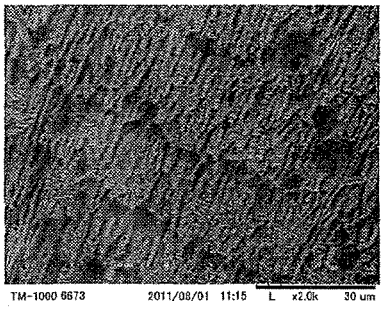
Figure 13:
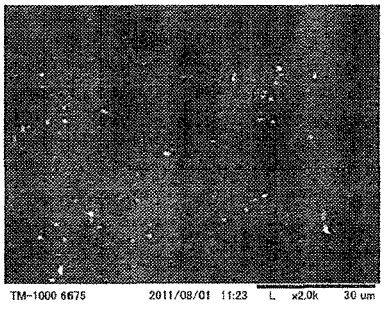
Figure 13:
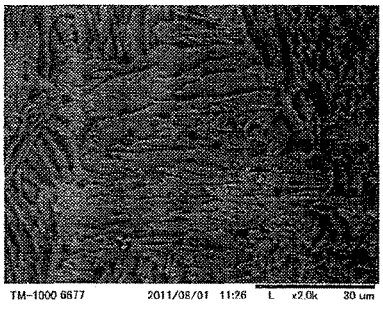
Figure 13:
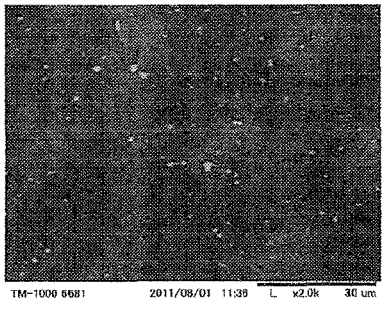
Figure 13:
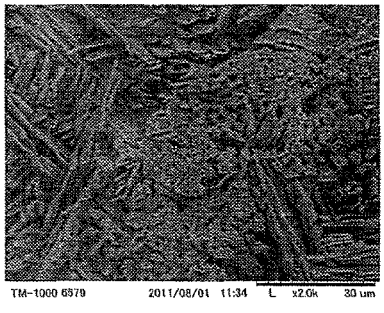
Figure 14:
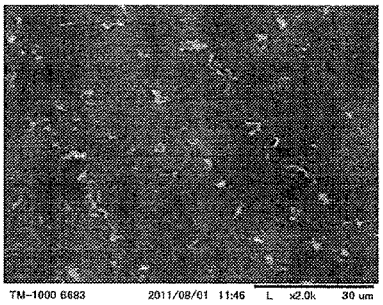
FIG. 14 includes micrograms showing the surfaces of copper alloys.
Figure 14:
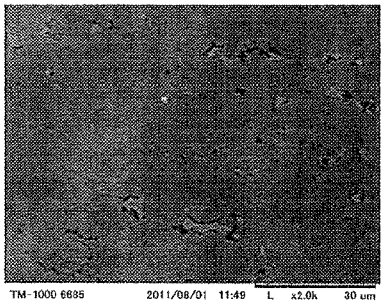
Figure 14:
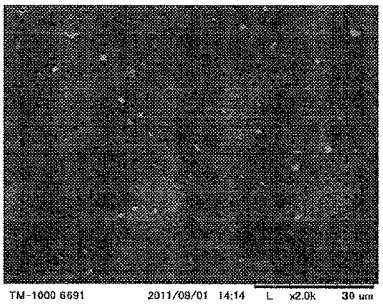
Figure 14:
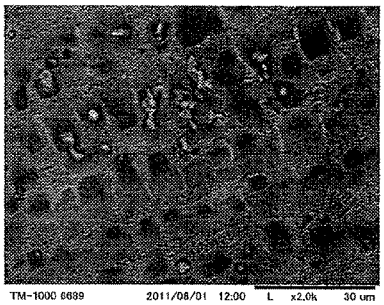
Figure 14:
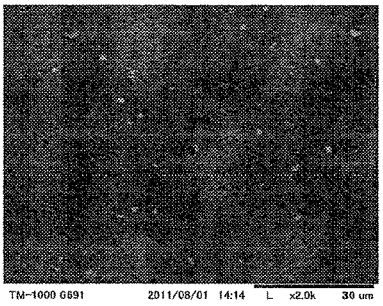
Figure 14:
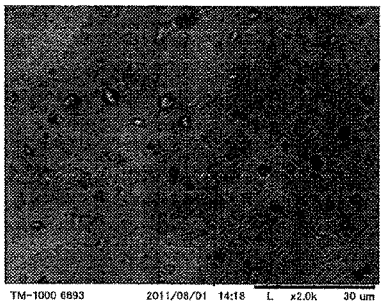
Figure 14:
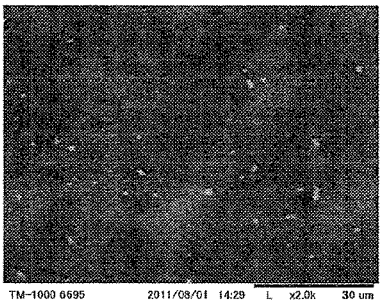
Figure 14:
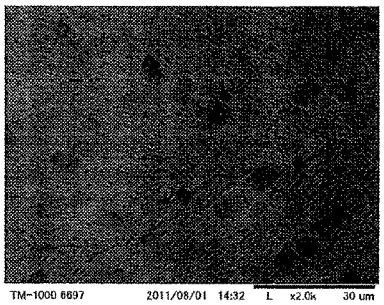
Figure 15:
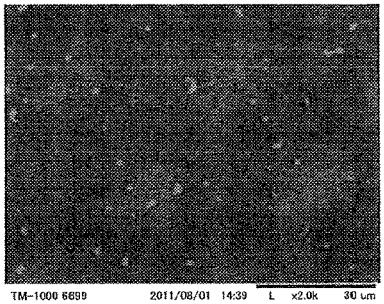
FIG. 15 includes micrograms showing the surfaces of copper alloys.
Figure 15:
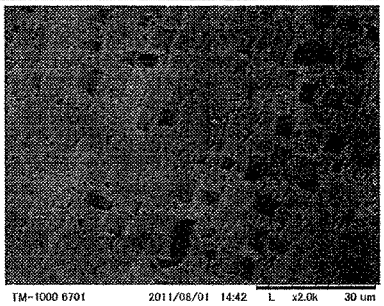
Figure 15:
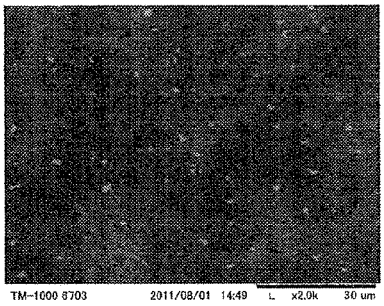
Figure 15:
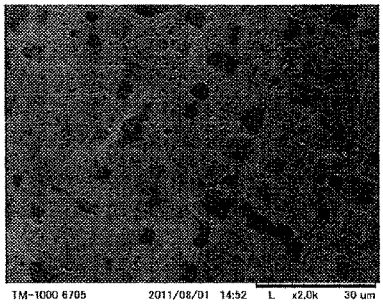
Figure 15:
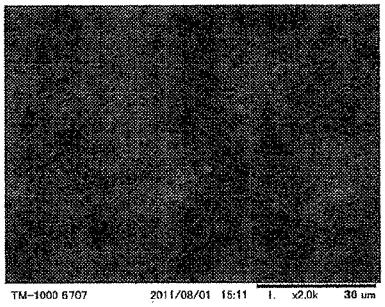
Figure 15:
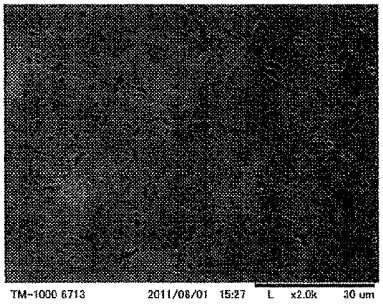
Figure 15:
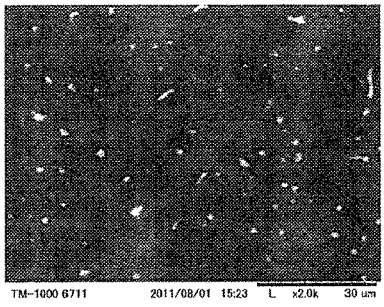
Figure 15:
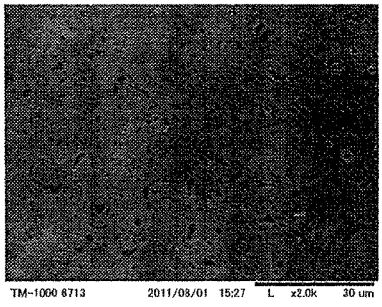
Figure 16:
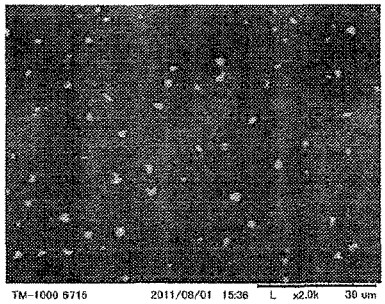
FIG. 16 includes micrograms showing the surfaces of copper alloys.
Figure 16:
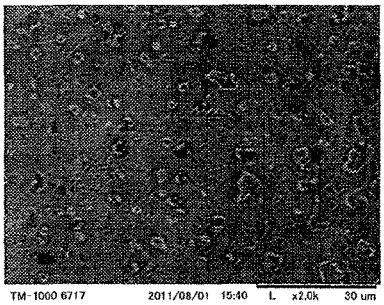
Figure 16:
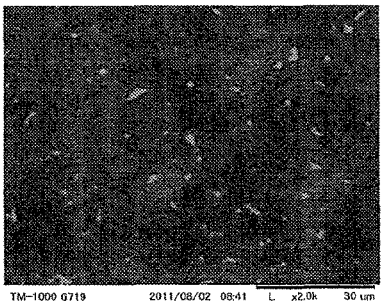
Figure 16:
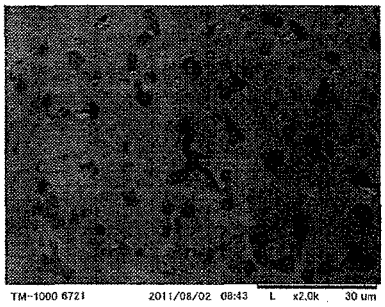
Figure 16:
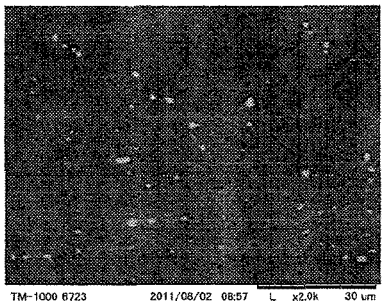
Figure 16:
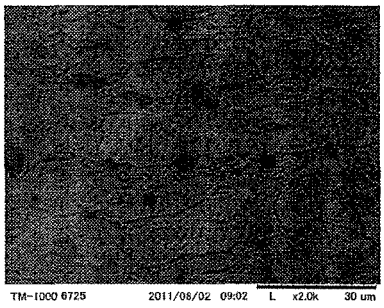
Figure 16:
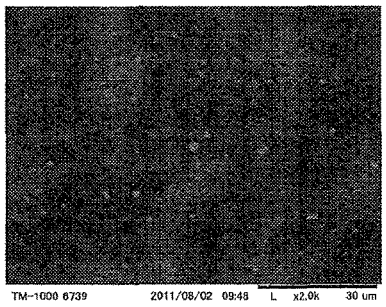
Figure 16:
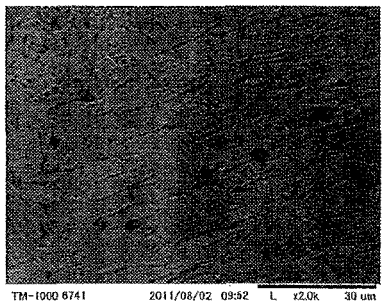

In view of the above, in the case of the nitric acid concentration of 3%, the Bi elution standard value becomes 0.65% and 0.68% in the case of the nitric acid concentration of 40%. Therefore, these cases are rejected. On the other hand, in the case of the nitric acid concentration of 4%, the Bi elution standard value becomes 0.34% and 0.39% in the case of the nitric acid concentration of 30%. Thus, both cases are accepted. Therefore, it is necessary that nitric acid for preferentially dissolving Bi and selectively removing Bi has a concentration of 4 to 30 mass %. It could be confirmed from Mini-SEM observation results of CAC911 in Table 7 and FIG. 9 before and after the treatment with 20% nitric acid for 10 min that Bi was selectively removed.

TABLE 7

| Results of Analysis using 20% nitric acid | Sn | Zn | Bi | Se | Pb | Cu |
|---|---|---|---|---|---|---|
| Chemical component value of Sample, mass % (Description: Table 2), P omitted | 4.0 | 8.1 | 1.5 | 0.18 | 0.47 | Balance (85.75) |
| 20% Nitric acid, Blank, mg/l | <0.1 | <0.1 | <0.1 | <0.1 | <0.1 | <0.1 |
| 20% Nitric acid, Elution amount after surface treatment, mg/l | 58 | 96 | 63 | <0.1 | 20 | 1200 |
| 20% Nitric acid, Elution amount after surface treatment in terms of percent, mass % | 4.0 | 6.7 | 4.4 | <0.01 | 1.39 | 83.5 |

The survey method in Table 7 comprised immersing CAC911 (having a surface area of 32.4 $cm^2$ of the sample having a ground surface) in 200 ml of 20% nitric acid for 10 min. The elution amounts of Sn, Zn, Bi, Se, Pb and Cu after the surface treatment were analyzed and the elution ratios of these elements were measured in terms of percent. By way of precaution, the analysis value of 20% nitric acid liquid (blank) before treatment was confirmed.

According to the survey results in Table 7, no contamination was found in the blank. In comparison with the chemical component values the sample, the elution ratios of Bi and Pb were higher than that of Cu in the case of 20% nitric acid after the surface treatment and it was confirmed from this fact that Bi and Pb were preferentially dissolved and selectively removed. Conventionally, it was thought that Cu and Bi were dissolved in nitric acid substantially in the same way. However, it was found that Bi could be preferentially dissolved while suppressing the dissolution of Cu through setting the concentration of the nitric acid to 4 to 20 mass %, preferably 10 to 20 mass %. In addition, it was found from Table 7 and FIG. 9 that Se and Zn were little dissolved in nitric acid.

Example 2

In order to measure the optimal shot-blasting time and shot ball diameter at the shot-blasting step, CAC911 casting having the chemical component values shown in Table 8 was used as Sample 2. Sample 2 was treated using 20 mass % nitric acid for 10 min and then subjected to shot-blasting under the conditions shown in Table 9 to analyze Bi and Pb on the sample surface with the XGT. The chemical component values of Sample 2 are shown in Table 8, and the shot-blasting conditions and measurement results of Bi and Pb after the shot-blasting step are shown in Table 9.

TABLE 8

| | Sn | Zn | Bi | Se | Pb | P | Cu |
|---|---|---|---|---|---|---|---|
| Chemical component value of Sample 2 (mass %) | 4.1 | 8.4 | 1.5 | 0.18 | 0.10 | 0.02 | Balance |

TABLE 9

| Shot-blasting time (min) | Stainless steel shot balls, φ0.3 mm Bi | Stainless steel shot balls, φ0.3 mm Pb | Steel shot balls, φ0.6 mm Bi | Steel shot balls, φ0.6 mm Pb |
|---|---|---|---|---|
| 0 | 0.20 | 0.04 | 0.20 | 0.04 |
| 1 | 0.28 | 0.04 | 0.22 | 0.04 |
| 2 | 0.37 | 0.04 | 0.26 | 0.03 |
| 5 | 0.39 | 0.04 | 0.48 | 0.06 |
| Without treatment | 1.17 | 0.16 | 1.17 | 0.16 |

Bi content: 1.5 mass %,
Lead content: 0.1 mass %

It was found from the results in Table 9 that Bi had a tendency to increase with the elapse of the shot-blasting time. At this time, since the XGT detected Bi that existed several μm below the surface, it could not be confirmed whether or not Bi was exposed from the surface by the shot-blasting. In addition, no tendency depending on the difference in particle size and material of the shot balls was confirmed. It can be said, however, that shot balls having a small diameter only producing smaller collision energy are preferred as the shot-blasting conditions.

Example 3

Subsequently, Sample 1 having the chemical component values shown in Table 2 was tested for lixiviation, and influences of the tendency to increase Bi with the elapse of the shot-blasting time affecting the lixiviation performance were verified. The relationship between the shot-blasting treatment time of Sample 1 and the lixiviation amounts of Bi and Pb tested is shown in Table 10.

TABLE 10

| Shot-blasting time: Stainless steel shot balls φ0.2 mm (min) | Lixiviation amount Bi (ppb) | Lixiviation amount Pb (ppb) |
|---|---|---|
| 0 | 26.9 | 7.1 |
| 1 | 28.0 | 8.0 |
| 3 | 24.2 | — |
| 5 | 25.8 | 6.9 |

Bi content: 1.5 mass %,
Pb content: 0.47 mass %

It was confirmed from the results of the lixiviation amounts of Bi and Pb per it shown in Table 10 that the lixiviation amounts of Bi and Pb did not increase with the elapse of the shot-blasting time at least up to 5 min.

In the results in Table 10, why the lixiviation amounts of Pb became high was that the Pb content ratio of Sample 1 was set to be high. For this reason, copper alloy having the Pb content ratio lower than Sample 1 was used as Sample 3 and tested for the same lixiviation as described in Table 11. As a result, the Pb lixiviation amount became 1.3 ppb that was lower than the desirable lixiviation amount of 5 ppb or less. In this case, the lixiviation amount of Bi was 25.4 ppb that was low similarly to the case of Sample 1.

TABLE 11

| | Sn | Zn | Bi | Se | Pb | P | Cu |
|---|---|---|---|---|---|---|---|
| Chemical component value of Sample 3 (mass %) | 4.0 | 8.0 | 1.3 | 0.19 | 0.03 | 0.02 | Balance |

Example 4

By measuring the reduced amount of mass of the copper alloy after the shot-blasting treatment, the thickness of the casting surface ground by shot-blasting was presumed. Sample 1 was used at this time as the copper alloy, and the number thereof was 84, the surface area thereof 112.95 $cm^2$ and the specific gravity thereof 8.75. On the other hand, the shot balls used at the shot-blasting step were 0.3 mm in diameter in the case of stainless shot balls and 0.6 mm in diameter in the case of steel shot balls. At this time, it was held that the thickness of the alloy ground by the shot-blasting (μm)=the amount of mass reduced (g)/(the surface area×the specific gravity of the copper alloy)×10000. The relationship among the shot-blasting time, amount of mass reduced and thickness of the alloy ground at the shot-blasting step according to the above formula is shown in FIG. 5.

Figure 5:
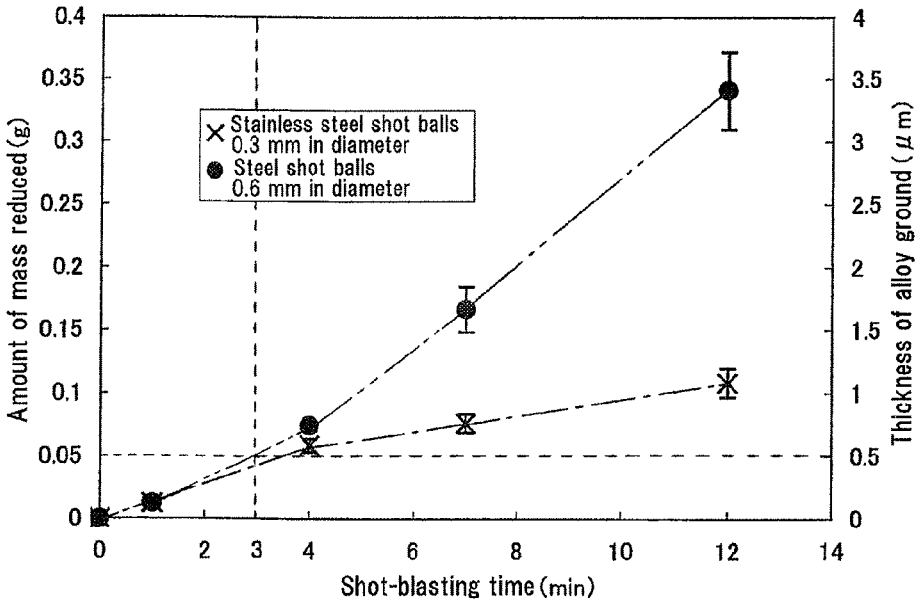
FIG. 5 is a graph showing the relationship among the shot time, mass reduction amount and grinding thickness.
Figure 6:
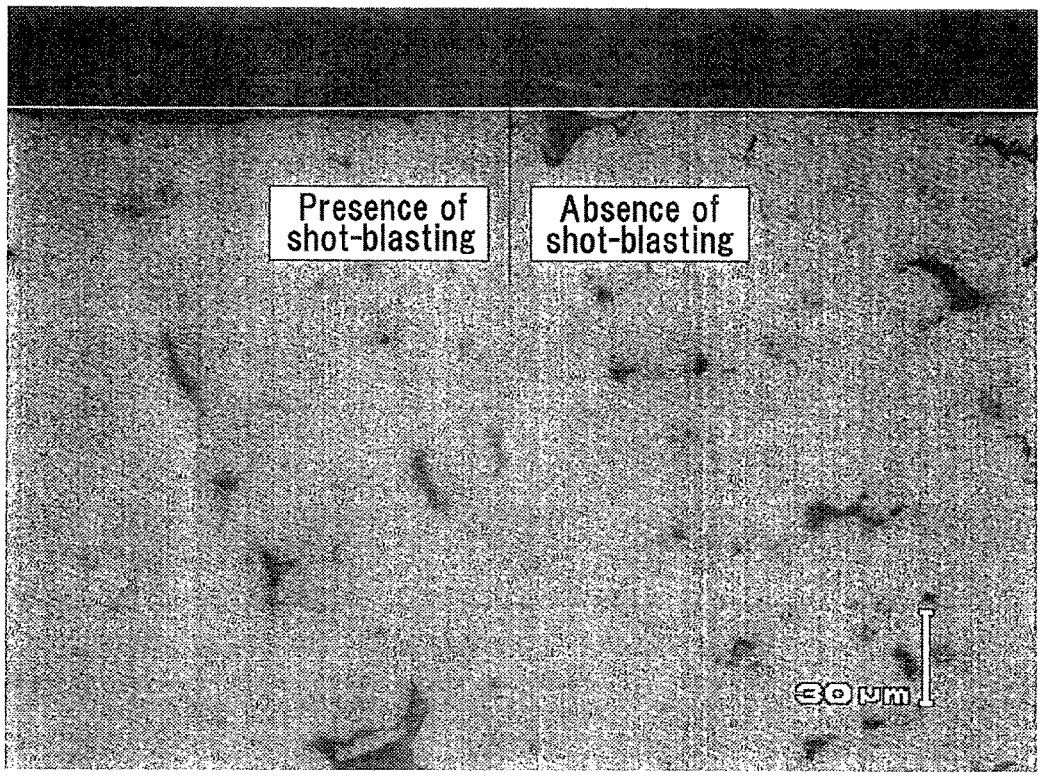
FIG. 6 is a microgram showing the cross section of copper alloy after shot-blasting FIGS. 7(*a*), 7(*b*) and 7(*c*) are micrograms showing the surfaces of copper alloys.

It is calculated from FIG. 5 that the thickness ground (grinding amount) is at least 0.5 μm or less when 3-min shot-blasting using the stainless-steel shot balls 0.3 min in diameter has been performed, for example. When actually observing the surface of Sample 1, however, as shown in the micrograms of FIG. 6, the result shows the surface ground by about 5 μm different in tendency from the calculation value based on the amount of the mass reduced. It is thought that the reason for it is that the shot-blasting crushes the material surface and, as a result, it is thought that it seems as if the amount ground is larger than the grinding thickness when grinding the material surface. Thus, it is difficult to actually measure the amount of the material ground by the shot-blasting. As described above, however, it is possible to foresee the grinding thickness based on the amount of the mass reduced.

Figure 7:
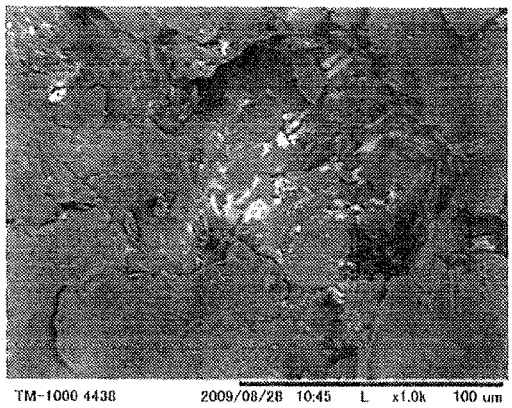
Figure 7:
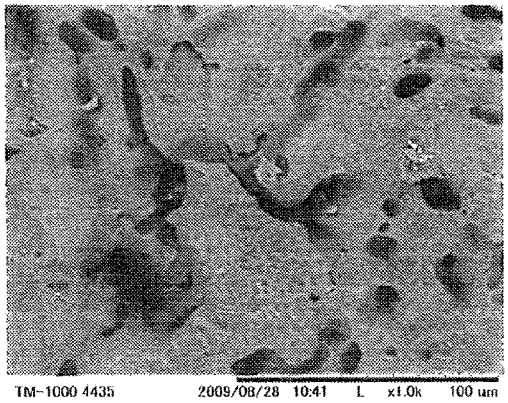
Figure 7:
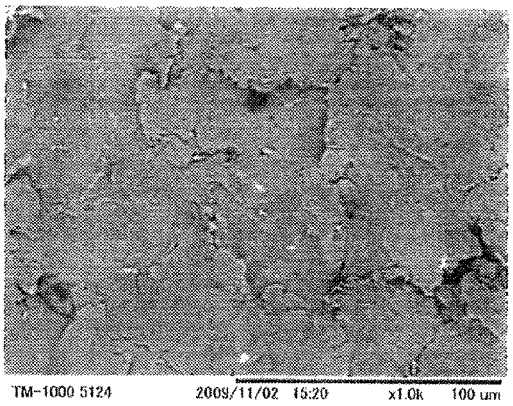

Here, discussed is the affection of the action of the shot balls that crushes the material surface by the shot-blasting affording the lixiviation performance. FIG. 7 are micrograms each showing the enlarged surface of Sample 1, in which FIG. 7(*a*) shows the as-cast surface, FIG. 7(*b*) the state in which the surface of FIG. 7(*a*) has been treated with 20 mass % nitric acid for 10 min and FIG. 7(*c*) the state in which the surface of FIG. 7(*b*) has been treated for 5 min using the stainless steel shot balls 0.3 mm in diameter.

It was confirmed from FIG. 7(*a*) that many Bi particles shown in white existed. In FIG. 7(*b*), the white parts disappeared by the surface treatment with 20 mass % nitric acid to remove Bi and, at the same time, the surface having undergone the shot-blasting was removed to allow an innocent alloy layer immediately below the removed surface to appear. In FIG. 7(*c*), though the surface in FIG. 7(*b*) crushed by the shot-blasting returned to the surface before being removed, few white parts were found. The white substances found in FIG. 7(*c*) mainly comprised those seen by the edge effect peculiar to the SEM (electronic microscope) and incrustations different from Bi. Thus, in the case of the surface ground by around 1 μm through the shot-blasting, it was confirmed that there is no existence of Bi in an amount exceeding the amount of Bi exposed and that around 5 μm surface crushing did not expose Bi from the surface.

Figure 8:
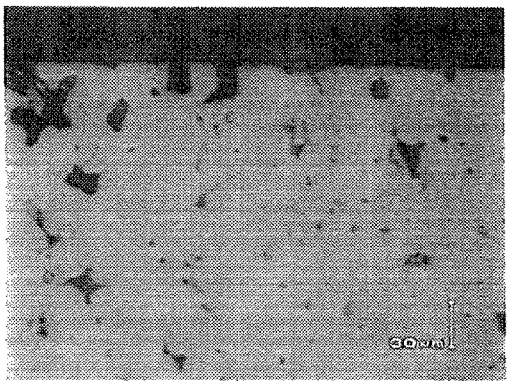
FIGS. 8(*a*), 8(*b*) and 8(*c*) are micrograms showing the sectional structures of the copper alloys.
Figure 8:
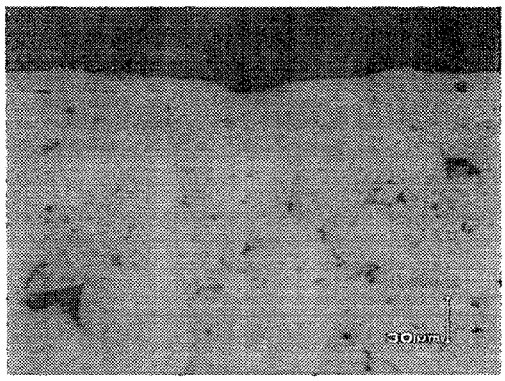
Figure 8:
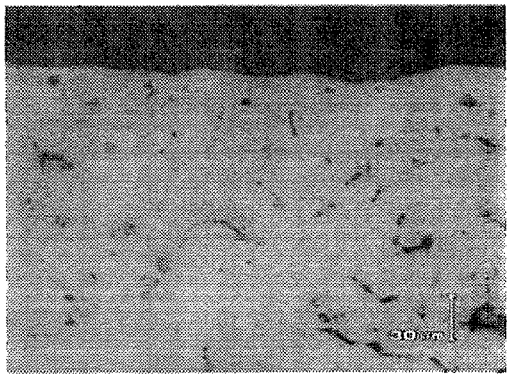

FIG. 8 includes micrograms showing the sectional structures of Sample 1, in which FIG. 8(*a*) shows a sectional structure of the surface treated with 20 mass % nitric acid and FIG. 8(*b*) and FIG. 8(*c*) show sectional structures of the surface in FIG. 8(*a*) treated with stainless-steel balls 0.2 mm in diameter for 3 min and then measured at different locations.

Black voids where Bi particles in nature have existed are found in the upper portion of FIG. 8(*a*), indicating that the Bi particles have been removed from the voids with 20 mass % nitric acid. In this case, the nitric acid is hard to penetrate depending on the modes of the Bi existence to possibly allow the Bi particles to remain deep in the voids as being not fully dissolved with the nitric acid. As shown in FIG. 8(*b*) and FIG. 8(*c*), however, the presence of the voids where the Bi particles have exited on the surface having undergone the shot-blasting has been little confirmed. It can be thought that the openings have been stopped up through the alloy surface compression resulting from the shot-blasting. Thus, it has been confirmed that the shot-blasting in nature aiming mainly at tarnish removal also fulfills its role of suppressing the elution of the Bi remaining deep in the voids. However, since a long shot-blasting time grinds the surface to expose Bi anew, shot-blasting time is preferably shortened to some extent capable of removing the tarnish.

In order to confirm various kinds of copper alloys the present invention targeted at, the following experiments were conducted. Test pieces having a surface area of 60 $mm^2$ were analyzed in respect of their surfaces under test conditions of the nitric acid concentration being 20% and the treatment time being 10 min. The presence of Bi and Pb on the surfaces was confirmed by the XGT analysis (X-ray analysis). The results thereof are shown in Table 12 to Table 14.

TABLE 12

Surface treatment for Bi removal
Component analysis results

| No. | Large classification | Small classification | Standard | Intended purpose |
|---|---|---|---|---|
| 1 | Bronze | | | |
| 2 | Bronze | | | |
| 3 | Bronze | | | |
| 4 | 7/3 brass | | | |
| 5 | 7/3 brass | | | |
| 6 | 6/4 brass | | | |
| 7 | 6/4 brass | | | |
| 25 | Silzin bronze | | | |
| 26 | Silzin bronze | | | |
| 27 | Silzin bronze | | | |
| 8 | 6/4 brass | Bi-based | C49260 | Brass rod |
| 9 | 6/4 brass | Bi—Se-based | C49300 | Brass rod |
| 10 | 6/4 brass | Bi-based | C49350 | Brass rod |
| 11 | 6/4 brass | Al-contained Bi—Se-based | C49255 | Brass rod |
| 12 | 6/4 brass | Al-contained Bi—Se-based | C89550 | Casting |
| 13 | 6/4 brass | Bi-based | C89560 | Casting |
| 14 | 6/4 brass | Ni-contained | C89940 | Casting |
| 15 | Bronze | Bi—Se-based | C89520 | Casting |
| 16 | Bronze | Bi—Se—P—Ni-based | C89845 (CAC912) | Casting |
| 17 | Bronze | Bi-Mm-based | C89837 | Casting |
| 18 | Bronze | Alloy containing a plenty of Zn | C89842 | Casting |
| 19 | Bronze | Bi—Ni-based | C89535 (CAC904) | Casting |
| 20 | Bronze | Bi-based Low Bi | CAC901 | Casting |
| 21 | Bronze | Bi-based-Sb-based | CAC903B | Metal mold casting |
| 22 | Bronze | Bi-based-Sb-based | CAC903B | Metal mold casting |
| 23 | Bronze | Bi-Mm-based | C89325 | Casting |
| 24 | Silzin bronze | Bi-contained Si-based | C49360 | Brass rod |
| 28 | Silzin bronze | Bi-contained Si-based | C89841 | Casting |

TABLE 13

| | Quantovac Analysis Results | | | | | | |
|---|---|---|---|---|---|---|---|
| No. | Cu % | Sn % | Zn % | Bi % | Se % | Sb % | P ppm |
| 1 | 90.1 | 4.42 | 4.86 | 0.28 | 0.01 | 0.01 | 237 |
| 2 | 89.2 | 4.32 | 5.06 | 1.06 | 0.01 | 0.01 | 240 |
| 3 | 87.9 | 4.50 | 5.04 | 2.18 | 0.01 | 0.01 | 209 |
| 4 | 71.6 | 0.01 | 27.15 | 0.92 | 0.02 | 0.01 | 198 |
| 5 | 70.4 | 0.00 | 27.17 | 2.07 | 0.02 | 0.01 | 227 |
| 6 | 58.0 | 0.01 | 40.55 | 0.95 | 0.01 | 0.00 | 1 |
| 7 | 57.7 | 0.01 | 39.99 | 1.87 | 0.01 | 0.00 | 1 |
| 25 | 75.2 | 0.01 | 20.77 | 0.69 | 0.01 | 0.00 | 18 |
| 26 | 74.6 | 0.01 | 20.77 | 1.39 | 0.01 | 0.00 | 18 |
| 27 | 74.9 | 0.01 | 20.74 | 0.99 | 0.01 | 0.00 | 20 |
| 8 | 61.0 | 0.01 | 37.56 | 1.06 | 0.01 | 0.00 | 920 |
| 9 | 60.8 | 1.18 | 36.65 | 1.05 | 0.01 | 0.10 | 1 |
| 10 | 62.3 | 2.18 | 33.68 | 1.52 | 0.01 | 0.07 | 800 |
| 11 | 59.7 | 0.01 | 37.95 | 2.07 | 0.01 | 0.00 | 1 |
| 12 | 62.2 | 0.55 | 35.20 | 0.84 | 0.04 | 0.00 | 1 |
| 13 | 60.4 | 0.01 | 37.00 | 1.66 | 0.01 | 0.00 | 1 |
| 14 | 64.6 | 3.99 | 3.86 | 4.55 | 0.01 | 0.00 | 191 |
| 15 | 85.2 | 5.54 | 5.27 | 2.26 | 0.78 | 0.01 | 193 |
| 16 | 87.4 | 3.01 | 7.26 | 1.26 | 0.14 | 0.01 | 1380 |
| 17 | 87.4 | 2.76 | 8.24 | 0.88 | 0.01 | 0.01 | 159 |
| 18 | 80.5 | 2.47 | 14.44 | 2.10 | 0.01 | 0.01 | 115 |
| 19 | 84.7 | 4.00 | 7.65 | 1.59 | 0.01 | 0.01 | 183 |
| 20 | 86.9 | 4.41 | 7.67 | 0.50 | 0.01 | 0.21 | 191 |
| 21 | 84.5 | 4.37 | 7.60 | 2.99 | 0.01 | 0.20 | 237 |
| 22 | 84.2 | 4.30 | 7.90 | 3.04 | 0.01 | 0.21 | 841 |
| 23 | 86.2 | 9.40 | 0.12 | 3.55 | 0.00 | 0.02 | 104 |
| 24 | 74.2 | 1.41 | 20.32 | 1.29 | 0.01 | 0.00 | 22 |
| 28 | 74.2 | 0.01 | 20.68 | 1.93 | 0.01 | 0.00 | 20 |

| | Quantovac Analysis Results | | | | | | |
|---|---|---|---|---|---|---|---|
| No. | Pb % | Ni % | Fe % | Si % | Al % | B ppm | Mm ppm |
| 1 | 0.26 | 0.01 | 0.02 | 0.00 | 0.00 | 5 | |
| 2 | 0.26 | 0.01 | 0.01 | 0.00 | 0.00 | 5 | |
| 3 | 0.27 | 0.01 | 0.01 | 0.00 | 0.00 | 5 | |
| 4 | 0.22 | 0.00 | 0.01 | 0..00 | 0.00 | 5 | |
| 5 | 0.23 | 0.00 | 0.00 | 0.00 | 0.00 | 5 | |
| 6 | 0.36 | 0.02 | 0.00 | 0.00 | 0.00 | 10 | |
| 7 | 0.35 | 0.02 | 0.00 | 0.00 | 0.00 | 9 | |
| 25 | 0.20 | 0.01 | 0.01 | 3.01 | 0.00 | 5 | |
| 26 | 0.21 | 0.01 | 0.02 | 2.99 | 0.00 | 5 | |
| 27 | 0.21 | 0.01 | 0.01 | 3.09 | 0.00 | 5 | |
| 8 | 0.14 | 0.02 | 0.00 | 0.00 | 0.00 | 9 | |
| 9 | 0.02 | 0.13 | 0.00 | 0.00 | 0.00 | 8 | |
| 10 | 0.13 | 0.02 | 0.00 | 0.00 | 0.00 | 6 | |
| 11 | 0.02 | 0.15 | 0.00 | 0.00 | 0.00 | 9 | |
| 12 | 0.13 | 0.44 | 0.00 | 0.00 | 0.51 | 7 | |
| 13 | 0.14 | 0.02 | 0.00 | 0.00 | 0.72 | 16 | |
| 14 | 0.02 | 22.07 | 0.87 | 0.00 | 0.00 | 5 | |
| 15 | 0.25 | 0.57 | 0.04 | 0.00 | 0.00 | 5 | |
| 16 | 0.23 | 0.53 | 0.03 | 0.00 | 0.00 | 5 | |
| 17 | 0.10 | 0.51 | 0.02 | 0.00 | 0.00 | 5 | 13 |
| 18 | 0.08 | 0.32 | 0.02 | 0.00 | 0.00 | 5 | |
| 19 | 0.08 | 1.93 | 0.03 | 0.00 | 0.00 | 5 | |
| 20 | 0.24 | 0.01 | 0.02 | 0.01 | 0.00 | 5 | |
| 21 | 0.22 | 0.01 | 0.06 | 0.01 | 0.00 | 5 | |
| 22 | 0.22 | 0.01 | 0.03 | 0.00 | 0.00 | 5 | |
| 23 | 0.11 | 0.54 | 0.01 | 0.00 | 0.00 | 5 | 13 |
| 24 | 0.07 | 0.01 | 0.02 | 2.60 | 0.00 | 5 | |
| 28 | 0.19 | 0.01 | 0.01 | 2.96 | 0.00 | 5 | |

TABLE 14

| | XGT analysis results | | | |
|---|---|---|---|---|
| | Bi | | Pb | |
| No. | Before treatment | After treatment | Before treatment | After treatment |
| 1 | 0.31 | 0.26 | 0.25 | 0.21 |
| 2 | 1.18 | 0.82 | 0.27 | 0.17 |
| 3 | 2.40 | 1.57 | 0.30 | 0.17 |
| 4 | 1.07 | 0.78 | 0.26 | 0.21 |
| 5 | 1.99 | 1.24 | 0.28 | 0.14 |
| 6 | 1.10 | 0.74 | 0.27 | 0.16 |
| 7 | 2.24 | 1.60 | 0.31 | 0.15 |
| 25 | 0.68 | 0.47 | 0.29 | 0.19 |
| 26 | 1.32 | 0.86 | 0.33 | 0.21 |
| 27 | 1.87 | 1.26 | 0.32 | 0.24 |
| 8 | 1.21 | 0.69 | 0.08 | 0.03 |
| 9 | 1.26 | 0.79 | 0.05 | 0.02 |
| 10 | 1.76 | 0.51 | 0.12 | 0.04 |
| 11 | 2.39 | 1.41 | 0.06 | 0.02 |
| 12 | 1.01 | 0.65 | 0.12 | 0.06 |
| 13 | 1.97 | 1.27 | 0.14 | 0.08 |
| 14 | 5.06 | 2.31 | 0.10 | 0.02 |
| 15 | 2.34 | 1.06 | 0.17 | 0.04 |
| 16 | 1.43 | 1.02 | 0.29 | 0.17 |
| 17 | 1.04 | 0.70 | 0.17 | 0.10 |
| 18 | 2.40 | 1.67 | 0.17 | 0.09 |
| 19 | 1.84 | 1.31 | 0.18 | 0.08 |
| 20 | 0.66 | 0.55 | 0.32 | 0.27 |
| 21 | 3.51 | 2.55 | 0.35 | 0.27 |
| 22 | 3.55 | 2.54 | 0.36 | 0.25 |
| 23 | 4.06 | 2.04 | 0.16 | 0.10 |
| 24 | 1.27 | 0.91 | 0.11 | 0.10 |
| 28 | 1.00 | 0.69 | 0.30 | 0.21 |

According to Table 11, Table 12 and Table 13, it was confirmed that bismuth and lead were removed from all the compositions. Therefore, it can be understood that the present invention targets at alloys at least having the component ranges comprising Cu: 57.7 to 90.1, Sn: 0.00 to 9.40, Zn: 0.12 to 40.55, Bi: 0.28 to 4.55, Se: 0.00 to 0.78, Sb: 0.00 to 0.21, P: 0 to 1380 ppm, Pb: 0.01 to 0.36, Ni: 0.00 to 22.07, Fe: 0.00 to 0.87, Si: 0.00 to 3.09, Al: 0.00 to 0.72, B: 0 to 16 ppm and Mm: 0 to 13 ppm. On the other hand, since the alloys had a difference in ratio of the removal of Bi, the Bi distribution on each surface was qualitatively confirmed with Mini-SEM (Scanning Electronic Microscope) (refer to FIGS. 10 to 16) According to the results thereof, it was confirmed that Bi and Pb were removed from all the compositions of the copper alloys.

The invention claimed is:

1. A method for preventing elution of Bi from copper alloy containing at least Bi and Pb having a surface thereof on which Bi and Pb is present, comprising treating the surface of the copper alloy with nitric acid having a concentration of 1.325 to 2.038 mol/L and subjecting the surface of the copper alloy to shot-blasting, wherein the treatment suppresses dissolution of Cu and preferentially dissolves Bi and Pb, wherein at least some of the Bi and at least some of the Pb is removed selectively, wherein the shot-blasting removes corrosive products that are oxides produced from the nitric acid and imparts gloss to the surface, wherein the shot-blasting is performed in a range of depths of void parts formed on the surface of the copper alloy as a result of removing at least some of the Bi using the nitric acid to suppress exposure of Bi present inward of the copper alloy, and wherein the shot-blasting blocks the void parts formed on the surface of the copper alloy as a result of removing at least some of the Bi using the nitric acid to suppress exposure of Bi present inward of the copper alloy.

* * * * *